US012631368B2

(12) United States Patent
Furman et al.

(10) Patent No.: US 12,631,368 B2
(45) Date of Patent: May 19, 2026

(54) TERMINAL UNIT AND METHOD FOR IMPROVED INDOOR COOLING

(71) Applicant: Chilled Beam Controls, LLC, Pittsburgh, PA (US)

(72) Inventors: Richard C. Furman, Atlanta, GA (US); Zachary M. Thomas, Pittsburgh, PA (US)

(73) Assignee: FT Energy Controls, LLC, Pittsburgh, PA (US)

( * ) Notice: Subject to any disclaimer, the term of this patent is extended or adjusted under 35 U.S.C. 154(b) by 775 days.

(21) Appl. No.: 17/530,388

(22) Filed: Nov. 18, 2021

(65) Prior Publication Data

US 2022/0154972 A1 May 19, 2022

Related U.S. Application Data

(60) Provisional application No. 63/143,188, filed on Jan. 29, 2021, provisional application No. 63/115,640, filed on Nov. 19, 2020.

(51) Int. Cl.
*F24F 13/22* (2006.01)
*F24F 11/83* (2018.01)
(Continued)

(52) U.S. Cl.
CPC ..... *F24F 13/22* (2013.01); *F24F 11/83* (2018.01); *F24F 2013/221* (2013.01);
(Continued)

(58) Field of Classification Search
CPC ..... F24F 2003/003; F24F 2003/005; F24F 11/83; F24F 11/84; F24F 11/85; F24F 2110/20; F24F 2110/22
See application file for complete search history.

(56) References Cited

U.S. PATENT DOCUMENTS 4,942,740 A * 7/1990 Shaw ..... F24F 3/1405 62/223
6,035,649 A 3/2000 Straub et al.
(Continued)

FOREIGN PATENT DOCUMENTS

JP 2006090597 A 4/2006
JP 3835453 B2 10/2006
(Continued)

OTHER PUBLICATIONS

Handbook of Formulae, Equations, and Conversion Factors for the Energy Professional, 1994, JOB Publications, Tallahassee, FL. pp. 87-89, 98-99 and 100-101.
(Continued)

*Primary Examiner* — Nelson J Nieves
(74) *Attorney, Agent, or Firm* — Zachary M. Thomas

(57) ABSTRACT

A terminal unit is provided for cooling a conditioned space. The terminal unit is provided conditioned air and augments cooling with a local heat exchanger. The terminal unit controls the flow of coolant through the heat exchanger. Latent cooling provided by the conditioned air is augmented by allowing moisture accumulation on the heat exchanger. The terminal unit lacks a drainage system so deleterious moisture accumulation (e.g., dripping) is avoided by monitoring moisture accumulation and controlling the terminal unit accordingly. If the moisture accumulation is below a threshold, the terminal unit is permitted to provide latent cooling locally. If the moisture accumulation is above a threshold, the terminal unit prevents further local latent cooling. Some sensor configurations allow for calculation of air flow rates, the latent cooling rate, and moisture accumulation. This information is used to achieve the desired room conditions more rapidly and precisely.

12 Claims, 6 Drawing Sheets

(51) Int. Cl.
*F24F 110/10* (2018.01)
*F24F 140/20* (2018.01)
*F24F 140/30* (2018.01)

(52) U.S. Cl.
CPC ..... *F24F 2110/10* (2018.01); *F24F 2140/20* (2018.01); *F24F 2140/30* (2018.01)

(56) References Cited

U.S. PATENT DOCUMENTS

| | | | | |
|---|---|---|---|---|
| 6,378,317 | B1 * | 4/2002 | Ribo | F24F 3/00 454/236 |
| 7,231,967 | B2 * | 6/2007 | Haglid | B25B 27/0035 165/231 |
| 10,921,012 | B1 * | 2/2021 | Walton | F24F 11/30 |
| 11,054,167 | B2 | 7/2021 | Furman et al. | |
| 2002/0164944 | A1 * | 11/2002 | Haglid | F28D 19/041 454/228 |
| 2008/0302112 | A1 * | 12/2008 | Anderson | F25B 45/00 62/93 |
| 2013/0139996 | A1 * | 6/2013 | Hashimoto | F24F 3/167 165/11.1 |
| 2013/0167571 | A1 * | 7/2013 | Nakagawa | F24F 11/30 236/44 A |
| 2014/0000836 | A1 * | 1/2014 | Xu | F24F 11/30 165/11.1 |
| 2015/0362200 | A1 * | 12/2015 | Hamada | F25B 49/022 62/175 |
| 2018/0259208 | A1 * | 9/2018 | Wang | F24F 13/222 |
| 2019/0195523 | A1 * | 6/2019 | Mowris | F24F 11/61 |
| 2019/0242597 | A1 * | 8/2019 | Hamada | F25B 7/00 |
| 2021/0011497 | A1 * | 1/2021 | Peterson | G05D 7/0635 |
| 2022/0146123 | A1 * | 5/2022 | Fujimoto | F25B 13/00 |
| 2022/0205661 | A1 * | 6/2022 | Fujita | G05D 23/1917 |
| 2022/0214071 | A1 * | 7/2022 | Tatsumi | F24F 11/74 |
| 2022/0268476 | A1 * | 8/2022 | Cimberio | F24F 11/84 |

FOREIGN PATENT DOCUMENTS

| | | | |
|---|---|---|---|
| JP | 6174385 | B2 | 8/2017 |
| JP | 6174386 | B2 | 8/2017 |
| JP | 6593797 | B2 | 10/2019 |

OTHER PUBLICATIONS

Jon Hildebrand, Solving Low Delta T Syndrome for Better Energy Efficiency, Belimo, Web Page <https://www.belimo.com/mam/corporate-communications/pictures-graphics/teasers/belimo-com/cesim/Belimo_Talks/Belimo_Presentation_Solving_Low_Delta_T_Syndrome_EN.pdf>, retrieved Jan. 26, 2022.

John Siegenthaler, Heat Exchangers in Hydronic and Plumbing Systems, Web Page <https://www.youtube.com/watch?v=rZEdSYxbxOI&list=PLuuV0ELkYb5VE0I4evUZ30b5U78CRIRdg&>, Aug. 1, 2021, retrieved Jan. 26, 2022.

Herb Hoerpel, Low Delta T Syndrome; Engineered Systems, Web Page <https://digitaledition.esmagazine.com/july-2021/editorsnote/?oly_enc_id=9752C5992023B2S>, Jul. 2021, retrieved Jan. 26, 2021.

Matching the Sensible Heat Ratio of Air Conditioning Equipment with the Building Load SHR, TIAX LLC, Web Page <http://seedengr.com/Making%20the%20Sensible%20Heat%20Ratio%20of%20Air%20Conditio hing%20Equipment%20with%20Building%20Load.pdf>, Nov. 12, 2003, retrieved Jan. 26, 2021.

How Low-Flow Systems Can Help You, Trane Engineers Newsletter, Aug. 1997, vol. 26, No. 2, Web Page <https://www.trane.com/content/dam/Trane/Commercial/global/products-systems/educationtraining/engineers-newsletters/waterside-design/en_26-02.pdf>, retrieved Jan. 26, 2021.

Ventilation for Acceptable Indoor Air Quality, ASHRAE 62.1-2016, Addendum d, Mar. 2, 2018, Web Page <https://www.ashrae.org/File%20Library/Technical%20Resources/Standards%20and%20Guidelines/Standards%20Addenda/62.Jan. 2016/62_1_2016_d_20180302.pdf>, retrieved Jan. 26, 2021.

Method of Testing to Determine Flow Resistance of HVAC Ducts and Fittings; ASHRAE Standard 120-2017, Feb. 1, 2017.

Standard Methods for Air Velocity and Airflow Measurement—ASHRAE Standard 41.2-2018, Jun. 1, 2018.

Terminal Units Catalog, Nailor Industries Inc. Web Page <https://nailor.com/sites/nailor.com/files/downloads/NailorCatalogTerminalUnitsCombined.pdf>, Jul. 2018, retrieved Jan. 26, 2021.

Decoupled Sensible Cooling Systems, Titus, Web Page <https://www.titus-hvac.com/file/12433/ASHRAE_Decoupled.Sensible.Cooling.pdf>, retrieved Jan. 26, 2021.

Chilled Water DOAS Fan Powered Terminal Units, Catalog 130.13-EG8 (317), Johnson Controls, 2017, Web Page <https://www.johnsoncontrols.com/-/media/jci/be/united-states/airside-systems/variable-air-volume-terminals-family/files/doas-fan-powered-vav/doas-engineering-guide.pdf>, retrieved Jan. 26, 2021.

Dedicated Outdoor Air System with Sensible-Cooling Terminal Units, Trane Engineering Newsletter, vol. 46-2, Jun. 2017, Web Page <https://www.trane.com/content/dam/Trane/Commercial/global/products-systems/education-training/engineers-newsletters/airside-design/admapn062en_062017.pdf>, retrieved Jan. 26, 2021.

Impact of DOAS Supply-Air Dew Point Temperature on Space Humidity; Trane Engineers Newsletter, vol. 49 -1, Mar. 2020, Web Page <https://www.trane.com/content/dam/Trane/Commercial/global/products-systems/education-training/engineers-newsletters/airside-design/ADM-APN073-EN_032020.pdf>, retrieved Jan. 26, 2021.

Application Guide Trane CoolSense System Design, Trane, Sep. 2020, Web Page <https://tranecds.custhelp.com/ci/fattach/get/293677/0/filename/CoolSense+Applications+Manual.pdf>, retrieved Jan. 26, 2021.

Trane Engineers Newsletter LIVE—Impact of DOAS Dew Point on Space Humidity, Feb. 28, 2020, Web Page <https://www.youtube.com/watch?v=4ap-sBndWtQ>, retrieved Jan. 26, 2021.

E. Taylor and D. Todey, Agronomy 541: Lesson 7a, Dew and Plant Diseases, Web Page <http://agron-www.agron.iastate.edu/courses/Agron541/classes/541/lesson07a/541L7.pdf>, retrieved Jan. 28, 2021.

Dew Point Control for Commercial Applications, Munters, Aug. 26, 2016, Web Page <https://www.munters.com/en/media/news/global-news/2016/dew-point-control-for-commercial-apps/>, retrieved Jan. 28, 2021.

* cited by examiner

TERMINAL UNIT AND METHOD FOR IMPROVED INDOOR COOLING

RELATED APPLICATION

The present application claims priority under 35 U.S.C. § 119(e) to U.S. provisional patent application, U.S. Ser. No. 63/115,640 filed Nov. 19, 2020, and U.S. provisional patent application, U.S. Ser. No. 63/143,188 filed Jan. 29, 2021, which are herein incorporated by reference in their entirety.

TECHNICAL FIELD

The present disclosure relates to the field of cooling indoor air.

BACKGROUND

Heating, ventilation, and air conditioning (HVAC) technologies have been developed for conditioning indoor air with the goal of effectively and efficiently providing comfort for occupants and/or satisfactory ambient conditions for property. Terminal units are a class of HVAC technologies which utilize a local heat exchange (e.g., coil) to perform some of the heating and/or cooling.

Typically, the heating and cooling provided by terminal units are augmented by a ventilation system that provides conditioned outside air. The terminal unit may be integral to the delivery of such air as it is with active chilled beams (ACBs) and sensible cooling terminal units (SCTUs). Other terminal unit examples include fan coil units (FCUs), direct expansion (DX) units, variable refrigerant flow (VRF) units and hybrid VRF/chilled water systems.

Ventilation air may be preconditioned by a Dedicated Outdoor Air System (DOAS). Energy Recovery Ventilators (ERVs) make use of the energy recovery process by exchanging the energy contained in the exhausted building air and use it to condition the incoming, outdoor air. An ERV is a type of air-to-air heat exchanger that not only transfers sensible heat but also latent heat. Since both temperature and moisture are transferred, ERVs can be considered as total enthalpy exchange devices.

The ERV technology has demonstrated an effective means of reducing energy costs and has allowed for the downsizing of chillers and boilers. Additionally, these systems allow for the indoor environment to maintain a more comfortable humidity level.

Various DOAS manufacturers are using energy recovery in their units. Some manufacturers are using enthalpy wheels in combination with desiccant wheels and cooling coils to obtain very low humidity levels. These ER-DOAS units are able to provide ventilation air that can provide all of the latent cooling (moisture removal) that is needed for humidity control. If the humidity is controlled, then the cooling coil only needs to do sensible cooling (temperature reduction). If the cooling coil does not condense any moisture, then no condensate is produced, and there is no need for a condensate pan and condensate drainage system.

SUMMARY

Some aspects relate to a terminal unit and method for improving indoor cooling by controlling and limiting moisture accumulation in the terminal unit. If the moisture accumulation is below a threshold, the terminal unit may be permitted to provide additional latent cooling using a cooling coil. If the moisture accumulation is above a threshold, the terminal unit may adjust control to prevent local latent cooling.

One aspect relates to a terminal unit comprising a coil; an actuator operably connected to the coil for regulating a first property of coolant entering the coil; a first sensor to measure a first measurement that is for a second property of ambient air; a second sensor to measure a second measurement; and a controller operably connected to the actuator and operably connected to receive the first and second measurements from the first and second sensors, respectively, and configured to (i) determine an amount of moisture accumulation in the terminal unit based at least in part on the second sensor measurement, (ii) determine a target value for the first property of the coolant entering the coil based at least in part on the first measurement and a set point value for the second property of the ambient air, the target value being bound within a range if the amount of moisture accumulation is greater than a threshold, the range defined at one end by a limit value associated with a maximum cooling rate, and (iii) control the actuator to achieve the target value for the coolant entering the coil.

In some embodiments the range is a first range, the limit value is a first limit value, and the maximum cooling rate is a first maximum cooling rate, and the controller is further configured to bound the target value within a second range if the amount of moisture accumulation is less than the threshold, the second range defined at one end by a second limit value associated with a second maximum cooling rate, the second maximum cooling rate being greater than the first maximum cooling rate.

In some embodiments, the controller adjusts the second limit value such that the second maximum cooling rate decreases as a difference between the threshold and the amount of moisture accumulation decreases.

In some embodiments, the one end of the range is a first end, and the limit value is a maximum cooling rate limit value, and the range is further bound at a second end by a minimum cooling rate limit value associated with a minimum cooling rate. In some embodiments, the minimum cooling rate is zero Watts.

In some embodiments, the terminal unit further comprises a drip pan positioned to collect moisture accumulation from the coil, wherein the second sensor measures the amount of moisture accumulation in the terminal unit in the drip pan.

In some embodiments, the first property of the coolant is temperature, and the limit value is a temperature determined from a dewpoint temperature of the ambient air.

In some embodiments, the coil is positioned such that the ambient air entering the terminal unit passes through the coil from an entry side of the coil to an exit side of the coil; the second sensor is located on the exit side of the coil; and the controller determines the amount of moisture accumulation in the terminal by (i) determining a first humidity based on measurement of the ambient air, (ii) determining a second humidity based at least in part from the second sensor, (iii) determining a difference in moisture content between air entering the coil and air exiting the coil based at least in part on the first and second humidity, and (iv) adding the difference in moisture content to a prior amount of moisture accumulation. In some embodiments, the controller in performing the summing time-weights each said difference in moisture content.

In some embodiments the terminal unit further comprises a third sensor located to measure air exiting the terminal unit, and the controller is further configured to estimate a flow rate of air through the coil based at least in part from measurements from the second and third sensors, and the controller in determining the difference in moisture content accounts for the flow rate of air through the coil.

In some embodiments the terminal unit further comprises a third sensor located to measure air exiting the terminal unit, and the coil is positioned such that ambient air entering the terminal unit passes through the coil from an entry side of the coil to an exit side of the coil, the second sensor is located on the exit side of the coil, and the controller determines the amount of moisture accumulation in the terminal by (i) determining a first humidity based on measurement of the ambient air, (ii) determining a second humidity based at least in part from the second sensor and the third sensor, (iii) determining a difference in moisture content between air entering the coil and air exiting the coil based at least in part on the first and second humidity, and (iv) adding the difference in moisture content to a prior amount of moisture accumulation.

Another aspect relates to a terminal unit comprising a coil; an actuator operably connected to the coil for regulating a property of coolant entering the coil; a conditioned-air port; a recirculation-air port; a supply-air port; a recirculation-air sensor positioned to measure a property of air entering the recirculation-air port; a second sensor to measure a property of air at a second location; and a controller operably connected to receive recirculation-air measurements from the recirculation-air sensor and second sensor measurements from the second sensor, and configured to estimate moisture accumulation in the terminal unit based on the recirculation-air measurements and the second sensor measurements, and configured to control the actuator to limit the moisture accumulation in the terminal unit during cooling.

In some embodiments the recirculation-air measurements include first temperature and first humidity measurements, and the second sensor measurements include second temperature and second humidity measurements; the controller further configured to calculate a latent cooling rate using the first and second temperature and humidity measurements and a flow rate of air through the coil; and the controller estimates the moisture accumulation from the latent cooling rate.

In some embodiments the coil is positioned such that room air entering the terminal unit through the recirculation-air port passes through the coil from an entry side of the coil to an exit side of the coil, and the second location is on the exit side of the coil to measure the property of the air exiting the coil.

In some embodiments the terminal unit further comprises a supply-air sensor positioned to measure a property of supply air being delivered from the supply-air port, wherein the controller is operably connected to receive supply-air measurements from the supply-air sensor, the coil is positioned such that room air entering the terminal unit through the recirculation-air port passes through the coil from an entry side of the coil to an exit side of the coil, the second location is on the exit side of the coil to measure the property of air exiting the coil, and the controller estimates the moisture accumulation in the terminal unit based on the recirculation-air measurements, the second sensor measurements, and the supply-air measurements.

In some embodiments the property of the room air entering the recirculation-air port measured by the recirculation-air sensor includes a first temperature and a first humidity; the property of the air at the second location measured by the second sensor includes a second temperature; the property of the supply air measured by the supply-air sensor includes a third temperature and a third humidity; and the controller estimates the moisture accumulation in the terminal unit by (i) estimating an air flow rate through the coil, (ii) estimating a change in humidity between the air entering and exiting the coil, (iii) calculating a latent cooling rate, and (iv) integrating the latent cooling rate.

In some embodiments the controller is further configured to control the actuator to achieve a non-positive value for the latent cooling rate if the moisture accumulation in the terminal unit exceeds a threshold.

In some embodiments the controller is further configured to estimate the air flow rate through the coil from measurements obtained from the second sensor and the supply-air sensor if the third temperature differs from the second temperature by at least a predetermined amount. In some embodiments the controller is further configured to calibrate the recirculation-air sensor and second sensor based on recirculation-air measurements and second sensor measurements collected during a time when the terminal unit is not receiving a call for heating or cooling.

Another aspect relates to a method of preventing excess moisture accumulation in a terminal unit, the method comprising measuring a first temperature and first humidity of air entering a recirculation-air port of the terminal unit; measuring a second temperature of air exiting a coil; measuring a third temperature and third humidity of air exiting the terminal unit through a supply-air port; estimating a latent cooling rate and moisture accumulation in the terminal unit based on at least the first, second and third temperature, and first and third humidity measurements; and controlling an actuator that is operably connected to the coil for regulating a property of coolant entering the coil to achieve a non-positive value for the latent cooling rate if the moisture accumulation in the terminal unit exceeds a threshold.

The foregoing is a non-limiting summary of the invention, which is defined by the attached claims.

BRIEF DESCRIPTION OF DRAWINGS

The accompanying drawings are not intended to be drawn to scale. In the drawings, each identical or nearly identical component that is illustrated in various figures may be represented by a like numeral. For purposes of clarity, not every component may be labeled in every drawing. In the drawings.

DETAILED DESCRIPTION

Figure 1:
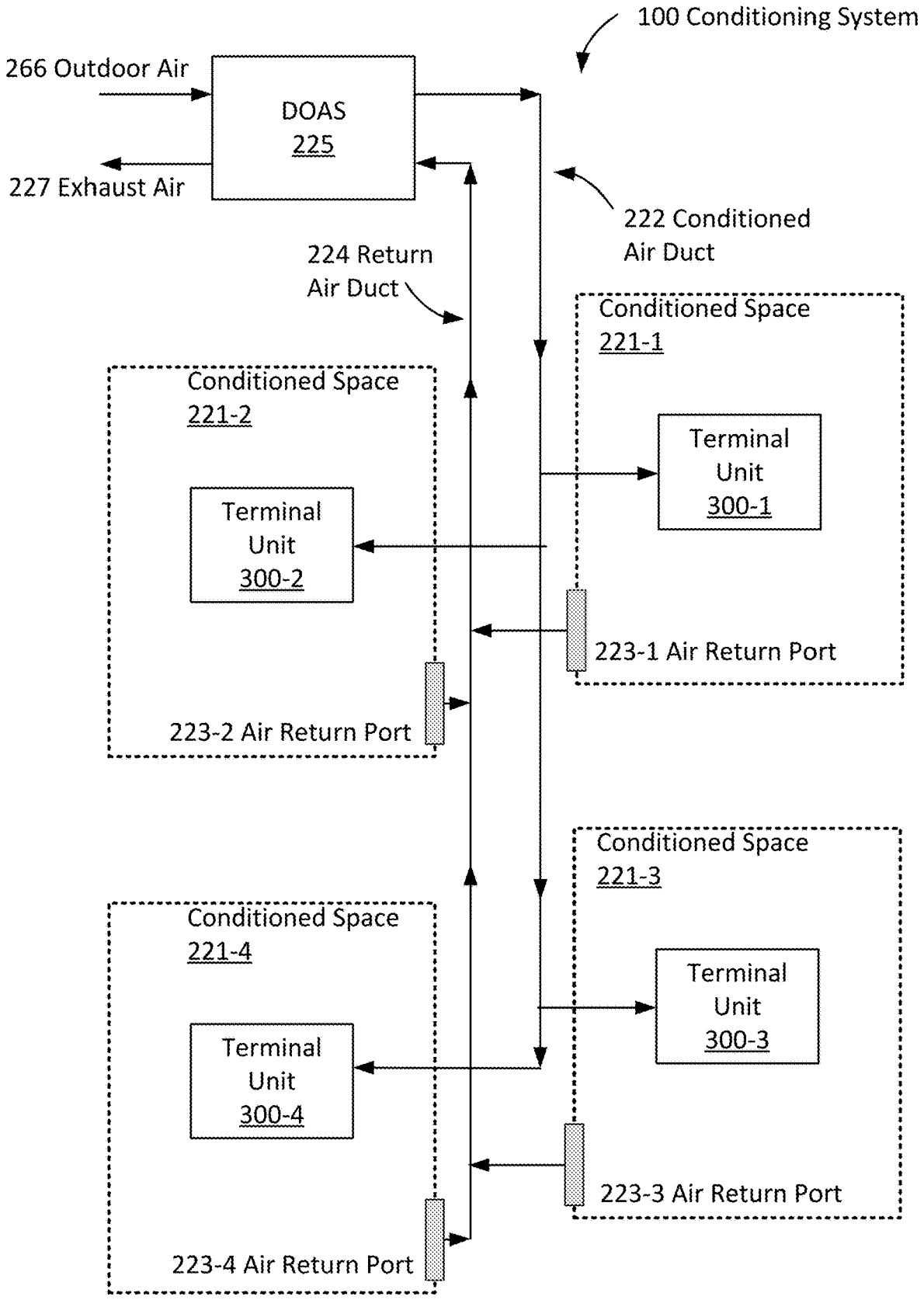
FIG. 1 shows a block diagram of a conditioning system, according to some embodiments.

There are many factors in achieving comfortable, healthy indoor air. Among these are the air temperature, the humidity, and the amount of "fresh" air. Conventional systems typically allow the user to set the desired air temperature. Humidity level is controlled largely as a side effect of the cooling process. The amount of fresh air may be determined by building codes and/or can be adjusted based on measured carbon dioxide levels.

Terminal units are a common solution for controlling conditioned spaces (e.g., rooms) within a building. A typical terminal unit-based building configuration is shown as conditioning system 100 in FIG. 1. A main conditioner 225 pre-conditions outdoor air 266 drawn into the system by adjusting the temperature and relative humidity of the air. It returns exhaust air 277 outside. Main conditioner 225 may be known as a dedicated outdoor air system (DOAS) or be any other suitable technology for pre-conditioning the outdoor air. For convenience, we herein refer to main condition 225 as DOAS 225 but recognize that other types of main conditioners may be used.

This air conditioned by DOAS 225 is delivered via conditioned air duct 222 to terminal units 300-N within the conditioned spaces 221-N. Here N represents all the instances shown. For simplicity, four instances are shown, but in practical systems there may be dozens or even hundreds of instances. (The "-N" is hereinafter suppressed for simplicity.) Each terminal unit 300 combines the conditioned air received from conditioned air duct 222 with recirculated air that the terminal unit conditions locally. The combination of the conditioned air from the DOAS 225 and the recirculated air is supplied to the respective conditioned space 300 with the goal of meeting a setpoint specified for that conditioned space. Return ducts 223 allow for air to exit the room via return duct 224 and be exhausted from the building. As shown in FIG. 1, the return air may pass through DOAS 225 to assist in the pre-conditioning of outdoor air 226 before being expelled as exhaust air 227.

Thus, for each conditioned space 221, a portion of the air conditioning is performed building wide by DOAS 225 and a portion of the air conditioning is performed locally by the respective terminal unit 300.

The inventors have recognized and appreciated that current control schemes to not effectively take advantage of the terminal units cooling capacity resulting in slower cooling and/or oversizing of heating, ventilation, and air conditioning (HVAC) equipment. Particularly, current control schemes may not utilize or underutilize a terminal unit's capability to perform latent cooling in addition to sensible cooling. Increasing the amount of latent cooling performed by a terminal unit, particularly when transitioning to a lower setpoint temperature can allow conditioning system 100 to more rapidly meet the set point temperatures in each of conditioned spaces 221 and allow for reduction in the capacity of system components. It also can allow for increased comfort by better regulating the amount of humidity in the air. For example, a person taking a hot shower may increase the humidity in a room. The terminal unit could augment the DOAS to remove moisture by latent cooling more quickly bringing the room back to a comfortable temperature and humidity.

One aspect relates to terminal units that do not have a drainage system for disposing of water condensed out of the air at the terminal unit. The inventors have recognized and appreciated that such terminal units still have considerable "reservoir capacity" to temporarily accumulate moisture on the cooling coil itself, and in a drip pan, if available. By utilizing this reservoir capacity, the terminal unit can more rapidly achieve a set point condition.

A system is described whereby the amount of moisture accumulation in the "reservoir" of the terminal unit is measured to ensure the reservoir capacity is not exceeded. More particularly, the amount of moisture accumulation in the terminal is measured and controlled to prevent the moisture accumulation from exceeding a threshold amount. The threshold may be defined, for example, as a percentage of the reservoir capacity to provide a margin of safety and allow for the finite response time required to control the rate of latent cooling. For example, the threshold may be set as 50%, 60%, 75%, 80%, or 90% of the reservoir capacity to provide the desired safety margin. Because only the amount of moisture accumulation relative to the threshold is required in some embodiments, moisture accumulation may be a relative measure. Though in some embodiments, an accurate absolute measure of moisture accumulation can be achieved.

When the amount of moisture accumulation in the terminal unit is under threshold, the terminal unit is free to perform latent cooling in addition to sensible cooling. When the threshold is reached, the terminal unit may be operated to only perform sensible cooling.

An aspect of the system is the methodology to measure the amount of moisture accumulation so as to verify the threshold is not exceeded. In systems with drip pans water level sensors or moisture detectors can be used to determine whether a threshold water level has been met. In systems without drip pans the condensation is essentially distributed across the coil and there is no where to put a "dip stick". However, the amount of condensed moisture can be estimated indirectly using a low-cost sensor suite. Information that can be determined from a one-time calibration can also be used. Before presenting the sensor suite and control algorithm a theoretical foundation is provided.

Consider an n-port device (n an integer) where each of the n ports exchanges air at a flow rate (volume per unit time) of $Q_j$, a temperature $T_j$, a humidity ratio $w_j$, a specific heat of $c_{pj}$, and a density of $\rho_j$, j representing the jth port. Assuming the device cannot sink our source air, water, or energy, conservation requires that:

$$\sum_{j=1}^{n} Q_j \rho_j c_{pj} T_j = 0 \quad (1)$$

and $$\sum_{j=1}^{n} Q_j \rho_j w_j = 0 \quad (2)$$

We hereinafter refer to Eq. 1 and 2 as the conservation equations. For HVAC applications $c_{pj}$ and $\rho_j$ may be sufficiently constant such that these terms can be dropped from both equations. These conservation equations are not true if cooling (heating) or condensation (evaporation) take place within the device. Thus, if the device contains a cooling (heating) coil the ports must be defined to exclude in order to apply the conservation equations. We return to these equations momentarily.

The sensible heating rate of air for a two-port device is $$h_s = c_p \rho Q \Delta T \quad (3)$$

where $h_s$ is the sensible heat (energy per unit time), $c_p$ is the specific heat of air, $\rho$ is the density of air, Q is the air flow volume and $\Delta T$ is the temperature difference between the two ports. Q and $\Delta T$ are measured in the same direction. In heating the air passing through the two-port device gets warmer and $h_s$ is positive. In cooling the passing through the two-port device gets colder and $h_s$ is negative. Since we are primarily concerned with cooling, we will refer to the "sensible cooling rate" which simply flips the sign of $h_s$ (i.e., positive value in cooling). For some HVAC applications the specific heat and density of air may be assumed constant and the sensible heating equation (Eq. 3) can be simplified, in Imperial units, to $$h_s \approx 1.08 \times Q\Delta T \quad 4$$

where $h_s$ is in units of Btu/hr, Q is in units of cubic feet per minute (CFM), and ΔT is the temperature difference in degrees Fahrenheit. A similar equation can be expressed in SI units.

The latent heat rate of air for a two-port device is $$h_l = \rho h_{we} Q\Delta w \quad 5$$

where $h_l$ is the latent heat (energy per unit time), ρ is the density of air, $h_{we}$ is the enthalpy of evaporation of water, and Δw is the humidity ratio difference between the two ports. Q and Δw are measured in the same direction. As with sensible cooling, for cooling we will generally flip the sign and refer to the "latent cooling rate". For HVAC applications the density and enthalpy of evaporation of water terms may be assumed constant and the latent heat equation (Eq. 4) can be simplified, in Imperial units, to $$h_l = 0.68 \times Q\Delta w \quad 6$$

Where $h_l$ is in units of Btu/hr, Q is in units of CFM, and Δw is unitless (e.g., humidity ratio measured in lb water/lb dry air). A similar equation can be expressed in SI units. Note humidity ratios in grains water/pound dry air can be converted using the definition of a grain (1 lb. water=7000 grains water).

The total cooling rate, $h_t$, is defined as $$h_t = h_s + h_l \quad 7$$

Figure 2:
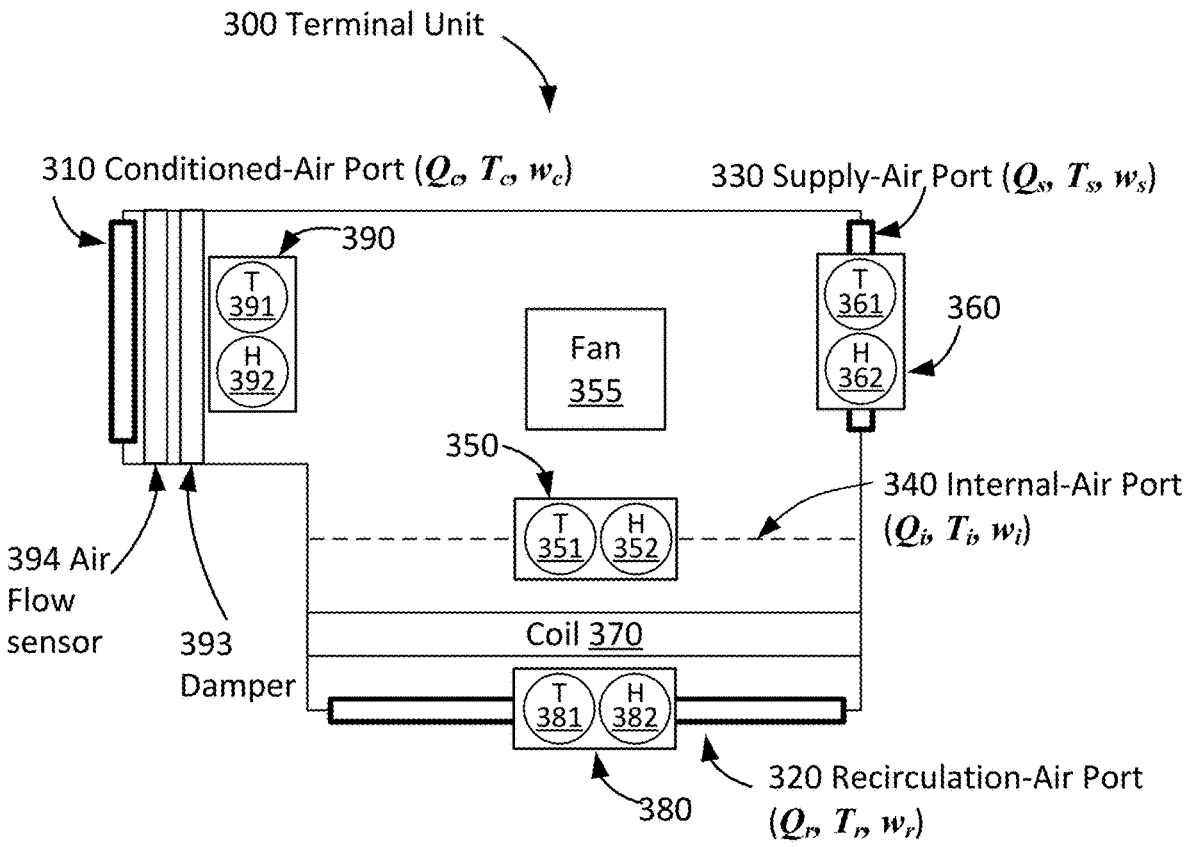
FIG. 2 shows a block diagram of a terminal unit, according to some embodiments.

Consider the case of a 3-port terminal unit 300 shown in FIG. 2. Terminal unit 300 could model an active chilled beam (ACB), a sensible cooling terminal unit (SCTU), and other types of HVAC terminal units. The configuration of terminal unit 300 is exemplary; the air ports and other features of the terminal unit may be configured in any suitable way. For simplicity, we use the same language for all such HVAC terminal units to refer to analogous ports. The port receiving conditioned air from a DOAS or other source is referred to as conditioned-air port 310 with a flow rate $Q_c$, temperature $T_c$, and a humidity ratio $w_c$. The port drawing in room air is referred to as the recirculation-air port 320 with a flow rate $Q_r$, temperature $T_r$, and a humidity ratio $w_r$. The port supplying conditioned air to the room is referred to as the supply-air port 330 with a flow rate $Q_s$, temperature $T_s$, and a humidity ratio $w_s$. Terminal unit 300 has a coil 370 through which air entering recirculation-air port 320 passes. Although referred to as a generally as a coil, coil 370 may be any suitable type of heat exchanger that allows energy transfer between air and a coolant. (The specific embodiment of a coil is referred to as a coil-type heat exchanger.) That is air entering recirculation-air port 320 passes through coil 370 by entering the coil on an entrance side of the coil and existing the coil on an exit side of the coil.

For clarity it is noted that such air does not enter the piping of the coil. The piping of the coil is used to pass coolant such as, for example, water or refrigerant. "Passing through" and similar language can be used to refer to both the air and the coolant and it should be clear to those of skill in the art that these refer to the respective physical phenomena.

An internal-air port 340 is defined on the exit side of coil 370. Internal-air port 340 has a flow rate $Q_i$, temperature $T_i$, and a humidity ratio $w_i$.

While conservation does not hold between the conditioned-air port 310, recirculation-air port 320, and supply-air port 330 because the coil adds or removes energy to the system, conservation holds between the conditioned-air port 310, internal-air port 340, and supply-air port 330 assuming there is no interior source or sink for energy (a reasonable assumption, for HVAC applications for example).

Finding the moisture accumulation C(t) in terminal unit 300 amounts to integrating the latent cooling rate divided by $h_{we}$, the enthalpy of evaporation of water:

$$C(t) = \int_0^{\tau} \frac{h_l}{h_{we}} dt \quad 8$$

where C(t) is the amount of water condensate as a function of time. In Eq. 8, $h_{we}$ is a constant and $h_l$ is determined from Eq. 5. In some embodiments, $h_{we}$ and ρ are considered constants and may be ignored if a relative measurement of latent cooling rate and moisture accumulation are sufficient. The remaining unknowns are Q and Δw and C(0).

Terminal unit 300 can be operated to ensure that C(0)=0 by, for example, running the coil in such a way as to ensure latent heating would occur unless the accumulated moisture is zero. For example, if there is moisture on the coil and the entering air is not saturated and the coil temperature is above the dew point of the entering air, the moisture accumulated on the coil will evaporate into the entering air. This can of course be accelerated by significantly increasing the temperature of the coolant in the coil above the dew point, possibly even operating in a heating mode. (Further bases for assuming zero moisture accumulation are discussed elsewhere.)

The variable Δw can be written as and $\Delta w = w_i - w_r$. The humidity ratio of air entering the recirculation-air port 320, $w_r$, may be determined from sensor 380. For example, sensor 380 may include temperature sensor 381 and humidity sensor 382 from which the humidity ratio may be determined. Because room air is entering the recirculation-air port these measurements may be in a highly accurate operating regime of a wide variety of commercially available sensors. The humidity ratio at the internal-air port, $w_i$, may be determined from sensor 350. For example, sensor 350 may include a temperature sensor 351 and humidity sensor 352 from which the humidity ratio may be determined. Because the humidity of the air existing coil 370 may be very high it may be more difficult to obtain an accurate reading of the humidity ratio, $w_i$, from humidity sensors whose accuracy or response time decreases at high humidity. If, for example, the response time of humidity sensor 352 is slower at high relatively humidity this could lead to large integration errors when calculating moisture accumulation. Our experiments have generally shown that the high humidity level does not significantly affect the responsiveness or accuracy of several low cost commercially available temperature sensors. Thus, in some embodiments, the humidity ratio at the internal air port may be calculated from the conservation equations as discussed further below.

The air flow rate Q is simply $Q_i$ (or $Q_r$ since $Q_i$ may be assumed equal to $Q_r$). In some embodiments the air flow rate Q can be assumed constant or proportional to the speed of fan 355. If terminal unit 300 does not have a fan, and the air flow rate may be assumed constant, and only a relative measure of moisture accumulation is desired, the air flow rate drops out and only Δw and C(0) need be determined. If terminal unit 300 has fan 355 and a relationship between air flow rate, Q, and fan speed may be assumed in some embodiments. The relationship may be relative or absolute (absolute meaning the air flow can be estimated in absolute terms based on the speed of fan 355.

If the air flow cannot be assumed constant or determined from the speed of fan 355 an absolute or relative measure of air flow speed may be determined from an air flow sensor (not shown) measuring the air flow through coil 370 or from the conservation equations as discussed further below. One example condition where the air flow rates may vary in a way that is difficult to predict is if terminal unit 300 includes a filter. Over time a filter may collect debris adding resistance to air flow and affecting the air flow rates in the terminal unit.

We now discuss computation of the humidity ratio at internal-air port 340 and of the air flow through coil 370 using the conservation equations. Taking the positive direction of air flow as into conditioned-air port 310 and internal-air port 340, and the positive direction of air flow as out of supply-air port 330 and assuming constant specific heat and density or air, Eqs. 1 and 2 are simplified and rearranged as shown in Eqs. 9 and 10.

$$Q_sT_s=Q_cT_c+Q_iT_i \tag{9}$$

$$Q_sw_s=Q_cw_c+Q_iw_i \tag{10}$$

Note that we use the internal-air port rather than the recirculation-air port in order to keep the coil "outside" the three-port system so that that conservation equations apply.

We can use Eqs. 9 and 10 to find $Q_i$ and $w_i$.

In practical systems the flow rate $Q_c$ of air entering conditioned-air port 310 is generally known or measured. In some embodiments this is because the amount of fresh air is generally regulated by applicable building codes. In some embodiments, terminal unit 300 may have an air damper 393 and air flow sensor 394. Damper 393 is any suitable device that may be controlled to dampen the amount of air entering conditioned-air port 310. Air flow sensor 394 is any suitable device for measuring the rate of air flow through conditioned-air port 310. In some embodiments, the position of damper 393 is determinative of the air flow rate obviating the need for a separate air flow sensor. In some embodiments, damper 393 and air flow sensor 394 are integrated into a single device. In some embodiments, terminal unit 300 includes a fan 355. Fan 355 may be a fixed-, multi-, or variable-speed fan positioned so as to draw air flow through coil 370. Fan 355 may also have conditioned-air port 310 on its suction side. If terminal unit 300 includes fan 355 we assume the fan does not produce enough heat to make the conservation equations inapplicable. This assumption can be made more accurate by isolating the fan motor from the air flows so as to minimize the amount of energy introduced into the three-port system. We see that Eqs. 9 and 10 can be rearranged to solve for $Q_i$ and $Q_s$ as shown in Eqs. 11 and 12.

$$Q_i = Q_c\left(\frac{T_cw_s - T_sw_c}{T_sw_i - T_iw_s}\right) \tag{11}$$

$$Q_s = Q_c\left(\frac{T_cw_i - T_iw_c}{T_sw_i - T_iw_s}\right) \tag{12}$$

Notably, assuming $Q_c$ is known, only temperatures and humidity ratios are needed to determine the flow rates. Thus, temperature and humidity sensors could be added at each of the ports to determine the unknown values. Specifically, FIG. 2 shows sensor 350 positioned at the internal-air port 340 of terminal unit 300 to measure the properties of air exiting coil 370. Sensor 350 may include a temperature sensor 351 and a humidity sensor 352. Sensor 360 is positioned to measure the properties of the air exiting supply-air port 330. Sensor 360 may include a temperature sensor 361 and a humidity sensor 362. Sensor 380 is positioned to measure the properties of the air entering recirculation-air port 320. Sensor 380 may include a temperature sensor 381 and a humidity sensor 382. Sensor 390 is positioned to measure the properties of the air entering conditioned-air port 310. Sensor 390 may include a temperature sensor 391 and a humidity sensor 392.

The temperature sensors may be any suitable sensor for measuring the temperature of the air such as a thermistor or a thermocouple. Though, any suitable temperature sensor may be used. The humidity sensors may be any suitable sensor for measuring the amount of humidity in the air. The humidity measurement may be a relative humidity, a humidity ratio, dew point, or any other suitable measure of humidity. It should be appreciated that humidity ratio and dew point temperature can be accurately calculated from temperature and relative humidity measurements.

The inventors have recognized and appreciated instrumenting terminal unit 300 with all of sensors 350, 360, 380, and 390 may be unnecessary in certain circumstances; in some embodiments a subset of sensors is used. For example, the temperature and humidity of the air entering conditioned-air port 310 (along with the flow rate) may be known based on configuration of the DOAS system to which conditioned-air port 310 to which the terminal unit is connected, eliminating the need in some embodiments for sensor 390.

Air Flow rate $Q_i$, may be estimated in other ways than by using Eq. 11 or its equivalents. For example, the inventors have recognized and appreciated that the temperature differences between Tc, Ti, and Ts are relatively small when measured on the absolute scale needed when evaluating Eq. 9. In practice, for some systems, the air flow rates $Q_s$ and $Q_i$ can be assumed constant for a given $Q_c$. Thus, in some embodiments air flow measurements for a given $Q_c$ can be taken using laboratory equipment and the values thereafter can be assumed.

In some embodiments, only small temperature differences are anticipated between $T_c$, $T_s$, and $T_i$, such that Eq. 9 can be simplified to $$Q_s \approx Q_c+Q_i \tag{13}$$

Substituting this expression into Eq. 9 and solving for $Q_i$ yields:

$$Q_i = Q_c\left(\frac{T_c - T_s}{T_s - T_i}\right) \tag{14}$$

Solving for $Q_s$ yields:

$$Q_s = Q_c\left(\frac{T_c - T_i}{T_s - T_i}\right) \tag{15}$$

Temperatures $T_s$ and $T_i$ may be known from measurement, for example, from sensors 351 and 361, respectively (with reference to FIG. 2). Temperature $T_c$ may be known from measurement, for example from sensor 391, or from defined properties of the conditioned air controlled by the DOAS. Air flow $Q_c$ may be known from measurement, for example, from air flow sensor 394, or from defined properties of the conditioned air controlled by the DOAS.

The inventors have recognized and appreciated that Eqs. 11, 14 and 15 are sensitive to measurement errors when the respective denominator terms are close to zero. In some embodiments, these equations are used to calculate the respective air flows when the temperature and humidity ratio values do not produce a denominator that is close to zero. For example, with reference to Eqs. 14 and 15, a difference of 1, 2, or 3 or more degrees Celsius or Fahrenheit may be required in the denominator before the calculation is assumed reliable. The calculated air flow rates may then be assumed constant and used at under different conditions or under a different operating mode. For example, the air flow rates may be calculated while operating in a heating mode and later used in the cooling mode. Such embodiments may allow for on-site calculation of the air flow rates without the use of expensive laboratory equipment.

The inventors have recognized and appreciated that the humidity ratio at the internal air-port, $w_i$, can be calculated indirectly from Eq. 10, as rearranged to Eq. 16.

$$w_i = \frac{1}{Q_i}(Q_s w_s - Q_c w_c) \qquad 16$$

Assuming the air flow rates $Q_i$, $Q_s$, and $Q_c$ are known, for example, using one of the aforementioned methods, only $w_s$ and $w_c$ are unknowns in Eq. 16. The humidity ratios at the supply-air port 330 and conditioned-air port 310 can simply be measured from sensor 360 and 390, respectively. Note that the relative humidity should not be very high at these ports and a wide variety of commercially available sensor should provide accurate measurements. In some embodiments $w_c$ can be assumed because, for example, the DOAS providing conditioned air provides air of a known temperature and humidity, and sensor 390 is not needed at conditioned-air port 310.

In some embodiments the air property sensors (e.g., temperature, humidity) are periodically calibrated to remove relative or absolute biases they have. The calibration may be performed automatically based on data collected while the terminal unit is in standby mode. In some embodiments the calibration is performed using data from the sensors collected where the sensors being calibrated can all be assumed to be at the same temperature and the same humidity. This may be a reasonable assumption, for example, when the coil has not had any flow through it for an extended period of time such that the coil is at room temperature. If the coil is at room temperature, it may be reasonable to assume sensor 380 at recirculation-air port 320 and sensor 350 at internal-air port 340 are at identical conditions. Further, if there is no flow at conditioned air port 310 it may be reasonable to also assume sensor 360 at supply-air port 360 is also under the same air conditions. The temperature sensors under conditions for calibration may be calibrated by averaging all sensor measurements over time and thereafter subtracting from each raw sensor measurement its difference from the average. For example, if sensor 381 measures 70° F. and sensor 351 measures 72° F. the average is 71° F. The difference between sensor 381's measurement and the average is −1° F. and the difference between sensor 351's measurement and the average is +1° F. These respective differences are subtracted from the subsequent sensor measurements of the respective sensors. Of course, measurements over several minutes may be used to produce an average that is not affected by random sensor noise. A similar approach can be use for three or more sensors as well as for humidity sensors or sensors of another property. Notably, this calibration can be done automatically anytime the conditions exist in which to utilize the sensor data for such a calibration. In some other embodiments, other suitable calibration methodologies may be used.

Having established a system for measuring moisture accumulation in the terminal unit, methods are discussed for determining the reservoir capacity and a threshold amount of moisture accumulation. The threshold should take into account the reservoir capacity of the system and the risk tolerance of the deployment as compared to the desire to maximize the cooling capacity of the terminal unit. In some embodiments, it may be unnecessary to measure reservoir capacity to establish a threshold; for example, if moisture accumulation is acquired as binary measure or as a water level in a drip pan.

The reservoir capacity can be determined by performing an experiment where the terminal unit is operated under conditions that result in latent cooling in the terminal unit. Moisture accumulation in the terminal unit is calculated using a suitable system and method (e.g., an embodiment described herein) and the conditions on the terminal unit are independently monitored until the reservoir capacity has been exceeded—resulting in dripping. In some tests a human observer observes the test and notes when dripping from the terminal unit first occurs. An alternative test is to use a moisture detector or level detector in the drip pan to monitor when moisture is first detected. This can also be a recalibration method used after the terminal units are installed. The moisture accumulation on the terminal unit at the time when dripping is first observed may be used as the reservoir capacity. Advantageously, because such a test uses the measurement system to determine moisture accumulation, the moisture accumulation estimated by the system may be a relative measure and not an absolute measure of the weight or volume of the water. Though, some embodiments will provide absolute measures of the weight and or volume of accumulated moisture.

The threshold amount of moisture accumulation may be specified in any suitable way. For example, in some embodiments it is determined in terms relative to the reservoir capacity (e.g., as a percentage) while in some other embodiments it is defined in absolute terms (e.g., as weight or volume).

It should be appreciated that in a practical system the air flow rate, temperature and humidity of the air at each of the ports may not be constant across the entire cross section of the port. Thus, a single temperature and humidity measurement for a port may be insufficient to characterize air entering or exiting that port. However, because an absolute measure of moisture accumulation may not be required, a single measurement may be sufficient. In some embodiments the positions of the sensors are maintained between any testing used to determine reservoir capacity and installation of the terminal unit. Alternatively or additionally, a safety margin may be built into the threshold to account for possible differences in placement of sensors between testing and installation. In some embodiments the determination of reservoir capacity is performed after installation to avoid sensor movement.

Sensor locations are discussed now with reference to each port. Though, the sensors may be placed in any suitable way. In some embodiments the recirculation-air sensor 380 may be placed near the center of recirculation-air port 320. Other embodiments may place sensor 380 at a location where the speed of air entering recirculation-air port 320 is high such as away from the edges or corners of recirculation air port 320. In some embodiments, sensor 380 is placed at a representative place in the room such as at a thermostat. Preferably, sensor 380 is placed away from supply-air port 330 to avoid obtaining sensor measurements that are more representative of the supply air than the air entering recirculation-air port 320.

In some embodiments, sensor 350 is placed at a central location relative to the air exiting coil 370. In some other embodiments, sensor 350 is placed near an inlet connection to coil 370 where the coolant enters coil 370. In some other embodiments, sensor 350 is placed near an outlet to coil 370 where coolant exists coil 370. In some embodiments sensor 350 is place at a location of relatively high air flow at internal-air port 340. In some embodiments, sensor 350 is placed opposite sensor 380 with respect to coil 370. In some embodiments sensor 350 is placed at least a characteristic length of the coil away from the coil (e.g., at least 1, 2, 3, 4 5, or 10 characteristic lengths away). The characteristic length may be defined, for example, as the spacing between adjacent pipe in the coil. By placing sensor 350 further way from the coil, non-uniformity in the property of the air may be reduced. However, at least in some embodiments, sensor 350 should not be positioned in a place where the air from conditioned-air port 310 has combined with the air coming through the coil.

In some embodiments, sensor 360 is placed centrally in supply-air port 330. In some other embodiments, sensor 360 is placed at a location of relatively high air flow coming through supply-air port 330. Though sensor 360 may be placed in any suitable way.

Sensor 390 may be placed similarly ways as sensor 360 but with reference to conditioned-air port 310.

If any of sensors 350, 360, 380, and 390 include multiple sensors (e.g., temperature and humidity), the sensor may be substantially collocated (e.g., as part of a single integrated sensor) or located at different locations for the respective port.

In some embodiments multiple sensors of the same type are placed at one or more ports to obtain a more accurate representation of the conditions at the respective port. The sensor results may be used to model the terminal system and calculate an estimate of the accumulated moisture. In some embodiments, multi-physics models are used to better estimate the air flow rates, temperatures, and humidity ratios at the ports based on limited sensor measurements. These multi-physics models maybe pre-computed to build tables which relate temperature and humidity measurement values to the flow rates at the ports and/or more representative temperature and humidity measurements for the ports. These look up tables may be used to better estimate air flow rates, temperatures, and humidity ratios based on the sensor measurements.

Figure 3:
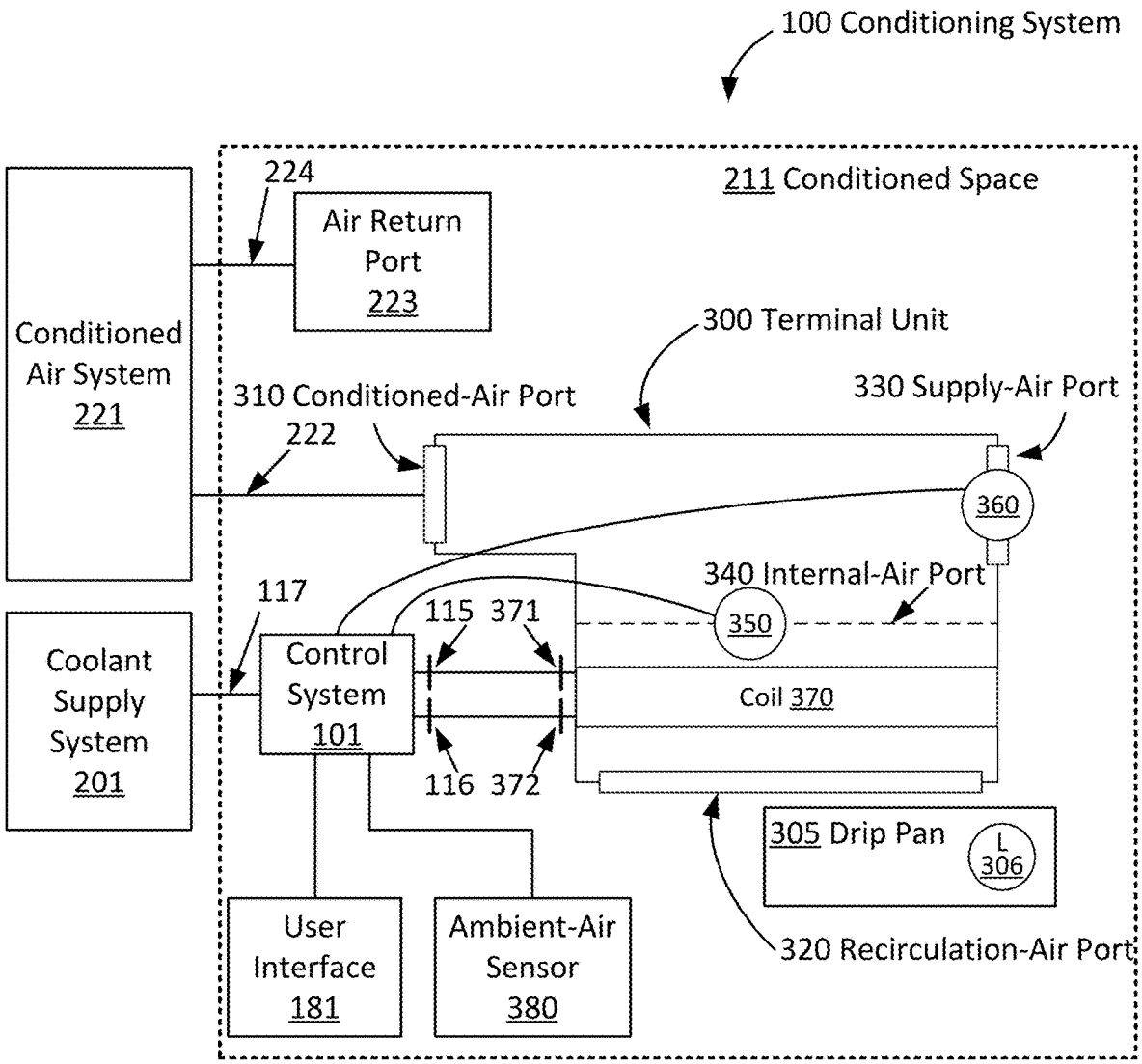
FIG. 3 shows a block diagram of a conditioning system, according to some embodiments.

Having discussed some aspects of the terminal unit, some additional context of the conditioning system in which terminal unit 300 is deployed is described, first with reference to FIG. 3.

FIG. 3 shows conditioning system 100 with detail on a single conditioned space 211. While only one terminal unit is shown in conditioned space 211, it should be appreciated that conditioned space 211 may have multiple terminal units providing conditioning of the air. The multiple terminal units may each have a control system 101, have separate control systems for each terminal unit, or each control system may service multiple, but not all terminal units. Though any suitable configuration of terminal units and control systems may be used.

Conditioning system 100 has a conditioned air system 221 which provides conditioned air to terminal unit 300's conditioned air port 310 via conditioned air duct 222. Conditioned space 211 has an air return port 223 that returns air via return air duct 224. Return air duct 224 may return air to the conditioned air system to assist in the conditioning or may exhaust the return air.

Terminal Unit 300 is controlled by control system 101. In some contexts control system 101 is referred to as part of terminal unit 300. Control system 101 receives sensor measurements and user inputs to control terminal unit 300. Control system 101 may control terminal unit 300 to achieve a setpoint specified by a user through a user interface 181. The setpoint may include, for example, a setpoint temperature and/or a setpoint humidity. Whether the system should perform cooling, heating, or determine such automatically may be specified through user interface 181. Additionally, terminal unit 300 may be turned off so that no local heating or cooling is performed by the terminal unit ("standby"). Note, even if the terminal unit is in standby the terminal unit may be configured to provide conditioned air from conditioned air system 211. In some embodiments control system 101 receives commands from an operator over a network connection. For example, control system 101 may be connected to a BACnet or MODBUS network to allow control and configuration of terminal unit 300, for example, from a building management system.

Control system 101 may control coolant provided to coil 370 of terminal unit 300. Coolant may be for example, water (including water-based), or refrigerant, and though the term coolant is used, coolant may be used to deliver heating or cooling through terminal unit 300. Coolant is supplied and returned to terminal unit through coolant supply system 201 via supply lines 117. As an example of a water-based coolant supply system providing both heating and cooling, supply lines 117 may include a hot water supply line, a hot water return line, a cold water supply line and a cold water return line. For a refrigerant-based coolant system, supply lines 117 may include a suction line and a liquid line. Control system 101 has a to-coil-inlet port 115 that is connected to coil inlet port 371 to provide coolant to coil 370. Control system 101 has a to-coil-outlet port 116 that is connected to coil outlet port 372 to return coolant from coil 370.

Control system 101 receives multiple sensor measurements. The sensors may include sensor 380 here labelled Ambient-Air sensor 380. As noted above, in connection with FIG. 2, sensor 380 may be situated in a variety of locations. In some embodiments, control system 101 is connected to one or more sensors located at a representative location(s) in the conditioned space 211. These sensor measurements may be the basis of control of the general heating and cooling and compared to the setpoint by control system 101. Another sensor may be located near the recirculation-air port 320 to better estimate properties of the air entering that port. This later sensor may be used for general heating and cooling control and/or for control of moisture accumulation.

Control system 101 is also shown connected to sensors 350 and 360. This is an illustrative example, as terminal unit 300 may have any, all or none of the sensors shown in FIG. 2. Control system 101 may be operably connected to some or all of the sensors actually installed in association with terminal unit 300. Control system 101 may also be configured to control damper 393 referenced in FIG. 2.

Terminal Unit 300 may include a drip pan 305 to collect moisture accumulation from coil 370. Coil 370 and terminal unit 300 may be shaped such as to facilitate collection of moisture into drip pan 305. For example, the coil and terminal unit may be shaped so as to utilize gravity and/or capillary action to collect moisture accumulated on coil 370 into drip pan 305.

Drip pan 305 may be equipped with a sensor 306. Sensor 306 may provide a measure of the water level or moisture in drip pan 305. Sensor 306 may be a capacitive based sensor, optical sensor, or utilize any suitable sensing or combination of sensing technologies. In some embodiments sensor 306 may provide a binary output indicating the presence or lack of moisture accumulation, while in other embodiments, sensor 306 may provide a range of values indicating varying levels of moisture accumulation. Sensor may be operably connected to control system 101 to provide measurements to the control system.

It should be appreciated that embodiments are generally described without a drip pan 305 and sensor 306. However, such description may apply to embodiments with drip pan 305 and sensor 306 with the addition that moisture may accumulate not only on coil 370 but also in drip pan 305. Particularly, the deleterious condition to be avoided in embodiments with drip pan 305 is overflowing of drip pan 305. The threshold is thus related to how full the drip pan is. In these embodiments, the sensor response associated with the reservoir capacity can be determined simply by filling drip pan 305 to its maximum capacity. This can be done artificially simply by pouring water into the drip pan until it is full. It is noted that sensor 306 will not have sensitivity to moisture accumulation until some amount of moisture is accumulated in drip pan 305. The threshold amount of moisture accumulation in such embodiments should not be lower than the minimum amount of moisture required to achieve a non-zero reading on sensor 306 unless moisture accumulation is also to be calculated based on the rate of latent cooling.

It should be appreciated that in some embodiments with drip pan 305 and sensor 306 air flow rates, the change in humidity between the air entering and exiting the coil, and the latent cooling rate are not estimated since the moisture accumulation can be measured directly by sensor 306.

Although coil 370 is shown at recirculation-air port 370, it should be appreciated that coil 370 may alternatively or additionally be located at other positions within terminal unit 300. For example, in some embodiments, coil 370 may be positioned at supply-air port 330. In some embodiments there are multiple coils; for example, a second coil may be positioned at supply-air port 330. One coil may be operated for cooling (e.g., at recirculation-air port 370) and the other for heating (e.g., at supply-air port 330). It should be appreciated that a suitable "internal" air port may be defined to permit application of the conservation equations as well as appropriate sensor placement based on known and unknown properties being used to calculate moisture accumulation or other derived quantities desired for operation of the terminal unit.

Figure 4:
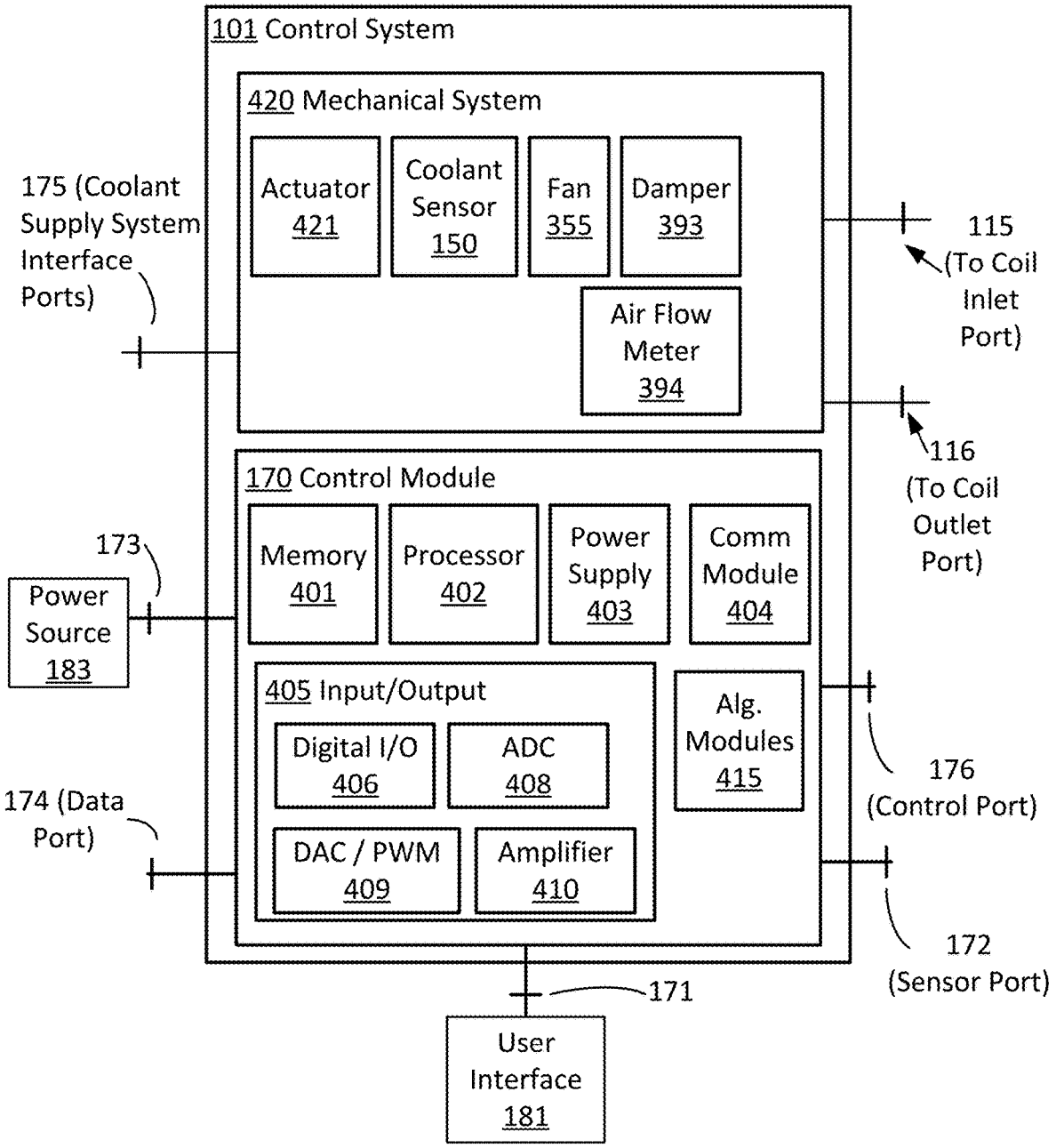
FIG. 4 shows a block diagram of a control system for a terminal unit, according to some embodiments.

Attention is now turned to FIG. 4 which shows control system 101 according to some embodiments. Control system 101 may be generally divided into a mechanical system 420 and a control module 170.

The mechanical system 420 of control system 101 is configured to deliver coolant to the coil of the terminal unit (e.g., coil 370 of terminal unit 300, with reference to FIG. 3) In some embodiments control system also controls air flow within the terminal unit. Mechanical system 420 may include an actuator 421, a coolant sensor 150, fan 355, damper 393, air flow sensor 394, coolant supply interface ports 175, a to-coil-inlet port 115 and a to-coil-outlet port 116. Note that components such as fan 355, damper 393 and air flow sensor 394 may be physically located within the duct work of the terminal unit, for example, as shown in FIG. 2.

Coolant supply interface ports 175 may be provided to interface with a coolant supply system. In one embodiment, the coolant is water and coolant supply interface ports 175 include cold water supply, hot water supply, cold water return, and hot water return ports. In another embodiment, a refrigerant is used and the coolant supply interface ports 175 include a suction port and a liquid port. Though any suitable ports may be used to interface control system 101 with the applicable coolant supply system.

Actuator 421 is a device configured to control a property of the coolant entering or going through the terminal unit's coil. Actuator 421 may be a control valve, pump (fixed-, multi-, or variable-speed), or any other suitable actuator or combination of actuators. Control module 170 may control actuator 421 based on various inputs such as from coolant sensor 150, user interface 181, sensors connected to sensor port 172, and remote commands received from data port 174.

Coolant sensor 150 may be provided to enable measurement of a property of the coolant. In some embodiments, coolant sensor 150 is a temperature sensor configured to measure a temperature of the coolant. In some other embodiments coolant sensor 150 measures a flow rate of the coolant. In some other embodiments, multiple sensors are used in combination to provide feedback for control system 101. In some embodiments, the relationship between the actuator's controlled setting (e.g., valve position, pump speed) may be sufficiently predictive of the property of the coolant that a distinction between the actuator's controlled setting and the property is unnecessary. In some such embodiments, feedback control and thus sensor 150 may be optional.

In some embodiments, actuator 421 is a control valve which is modulated to control a temperature of coolant entering the coil. In some embodiments, actuator 421 is a control valve which is modulated to control a flow rate of coolant going through the coil. For example, the coolant may be a refrigerant and the actuator 421 is modulated to achieve a refrigerant flow rate. Feedback is provided by a suitable coolant sensor 150.

Some embodiments may include a fan 355. Fan 355 may be positioned in the terminal unit to affect air flow coming in through the recirculation-air port and/or the conditioned-air port of a terminal unit. Though the fan may be positioned to affect air flow in any of the air ports. Fan 355 may be a fixed-, multi-, or variable-speed fan. For example, fan 355 may be an ECM (electronically commutated motor) fan. In some embodiments, fan 355 includes an air filter.

Some embodiments of control system 101 may include a damper 393. Damper 393 may be used to restrict air-flow. Damper 393 may be electronically controlled. Damper 393 may be used with any port of a terminal unit such as the conditioned-air port (as shown in FIG. 2), the recirculation-air port, internal-air port, or the supply-air port. Multiple dampers 393 may be used in some embodiments. Note that a terminal unit may have additional fixed dampers that are set mechanically (e.g., by a screw) and are not controlled electronically.

Damper 393, fan 355, and actuator 421 may be operably connected for control by control module 170 via control port 176. Each device may be connected to Control port 176 via wire and/or wirelessly. Though, any suitable method may be used to provide control signals to damper 393, fan 355, and actuator 421.

Some embodiments of control system 101 may include an air flow sensor 394. Air flow sensor 394 may be used to measure air flow through a port of a terminal unit such as the conditioned-air port (as shown in FIG. 2), the recirculation-air port, internal-air port, or the supply-air port. Multiple air flow sensors may be used in some embodiments.

Control system 101 may include power port 173 which may be connected to a power source 183. Power port 173 may receive electrical power needed to operate control system 101. While power port 173 is shown connected to control module 170, it should be appreciated that power may be provided to various other components of control system 101 directly or through control module 170. In some embodiments, power is provided for internally by control system 101. For example, control system 101 may be battery powered, include a generator, or use a suitable combination of battery storage, generators, and external power sources.

In some embodiments control module 170 includes data port 174 for communicating with other devices such as a control and monitoring center, other control systems, and the like.

In some embodiments, control module 170 has a user interface port 171 for connecting to a user interface such as user interface 181. A user interface 181 may provide an interface for a user of the conditioned space to control system 101. User interface 181 may allow a user to, among other things, indicate whether conditioning of the air in a conditioned space is desired, the type of conditioning (e.g., heating or cooling), a setpoint temperature and/or humidity specifying a desired temperature and/or humidity in the conditioned space, and to create a schedule for operation of control system 101. User interface 181 may also present information about the status of control system 101, the conditioned space, and the like to the user. In some embodiments, user interface 181 is a computer or other electronic device with any suitable combination of user interface devices such as a display, keypad, haptic feedback, speaker, microphone, touch screen, mouse, trackball, and other types of user interface devices.

Control module 170 may have a sensor port 172 for connecting various sensors. For example, sensors 350, 360, 380, and 390 of FIG. 2 and FIG. 3 may interface with control system 101 through sensor port 172. Air flow sensor 394 may also be connected to sensor port 172. Sensor port 172 may be wired, wireless, or a combination thereof. However, control system 101 may be operably connected to the various sensors to receive sensor measurements in any suitable way.

Control module 170 may include a plurality of modules such as memory 401, processor 402, power supply 403, communications module 404, algorithm control modules 415, and input/output (I/O) modules 405.

Processor 402 may be configured to implement control algorithms in response to input signals received by control module 170. Processor 402 may be operatively connected to memory 401 and other modules of control module 170. Processor 402 may be any suitable processing device such as for example and not limitation, a central processing unit (CPU), digital signal processor (DSP), field programmable gate array (FPGA), application specific integrated circuit (ASIC), or any suitable processing device or combination of processing devices. In some embodiments, processor 402 comprises one or more processors, for example, processor 402 may have multiple cores and/or multiple microchips.

Memory 401 may be integrated into processor 402 and/or may include "off-chip" memory that may be accessible to processor 402, for example, via a memory bus (not shown). In some embodiments, memory 401 stores software modules that when executed by processor 402 perform desired functions; in some embodiments memory 401 stores an FPGA configuration file for configuring processor 402. Memory 401 may be any suitable type of non-transient, computer-readable storage medium such as, for example and not limitation, RAM, ROM, EEPROM, PROM, volatile and non-volatile memory devices, flash memories, or other tangible, non-transient computer storage medium.

Power supply 403 provides the power signals for the operation of control module 170 and other electrical devices in control system 400. Power supply 403 may use power source 183 to facilitate generation of such power signals, though other sources of power may be used. For example, power source 183 may provide a 120V AC power signal to control system 400. Power supply 403 may convert the provided AC signal into DC voltage signals suitable for operation of various components of control system 400. For example, control module 170 may require 3.3V and/or 5V, actuator 421 may require 12 V and/or 24V. Thus, power supply 403 may convert the 120V AC power signal into these various DC voltage signals, or any other signals based on the requirements of a particular embodiment.

Communications module 404 may be any suitable combination of hardware and software configured to generate and receive communication signals over data port 174. Data port 174 may include a wired data port, a wireless data port, or both. Data port 174 may provide a connection to a network such as a LAN, WAN, the internet, and/or another device using any suitable communications protocol. Communications module 404 may be configured to communicate with other control systems, a centralized control and monitoring center, or any other device. For example, multiple controls systems may be connected together and to a control and monitoring center to facilitate data logging, reconfiguration of the connected control systems and the like. In some embodiments, multiple control systems are daisy chained together; to facilitate this port 174 may include two or more physical connectors to allow each control system to be connected by cable into the next. Other suitable network topologies may also be used.

Algorithm control modules 415 includes implementation hardware and/or software for implementing methods of controlling the terminal unit. Modules 415 may implement any suitable control algorithm for controlling the terminal unit to achieve the desired operation. Algorithm control modules implemented in software may be stored in memory 401 for processing by processor 402. Algorithm control modules implemented in hardware may be implemented as part of processor 402. Though algorithm control modules 415 may each be implemented in any suitable way.

I/O 405 may include digital I/O 406, analog-to-digital converter 408 (ADC 408), digital-to-analog converter/pulse width modulator 409 (DAC/PWM 409), and amplifier 410. I/O 405 permits signaling with other devices and sensors connected to control module 407. I/O 405 is not limited to these types of input and output, and the discussion of the use of I/O 405 is exemplary and other input/output mechanisms may be used in other embodiments.

Digital I/O 406 allows for digital signaling of input and/or output signals. For example, coolant sensor 150 and user interface 181 may utilize digital communication protocols that utilize digital I/O 406.

ADC 408 allows analog signal to be processed digitally by converting such signals into a sequence of digital bits. For example, sensor 150 may be a thermistor which has a resistance that varies predictably with temperature. A suitable circuit (e.g., voltage divider) and ADC 408 may be used to convert a voltage measurement into a digital signal. The digital signal may then be processed by processor 402 (or otherwise) to determine the temperature from the thermistor. As another example, sensor 150 may be a thermocouple whose voltage may be converted to a digital signal directly by ADC 408 or after a suitable signal conditioning circuit (e.g., amplification, low pass filtering).

DAC/PWM 409 represent two forms of outputting an analog voltage signal. Digital-to-analog converters may convert digital inputs into analog outputs with discrete increments (though such increments may be below the noise floor in some cases). Pulse width modulation (PWM) may simulate an analog voltage level by switching between digital values at high frequency. The time average voltage value controlled by varying the duty cycle. Low pass filtering can be used to remove the high frequency switching content leaving the time average voltage signal level. DACs or PWMs may, for example, be used to provide an analog output signals for controlling actuator 421, fan 355, and damper 393.

Amplifier 410 may increase the voltage or current of a low power signal, such as a signal output by digital I/O 406 or DAC/PWM 409. For example, actuator 421 may be a control valve that requires an analog voltage input between 2 and 10 volts to vary the valve position from completely closed (e.g., at 2V) to completely open (e.g., at 10V). A PWM signal may be generated by a 3.3V digital device (logic 0 at 0 V, logic 1 at 3.3V)—thus the time average voltage of the PWM signal can only be between 0 and 3.3 volts. To use the PWM signal to control valve 130, amplifier 410 may be configured to multiply the input voltage by a little over 3 and the resultant signal used for control.

Control module 170 may send or receive signals to sensors and actuators associated with control system 101 as well as provide electrical power to such devices. Though, in some embodiments power may be provided directly by power source 183 or another source. In some cases, the control signal and power may be the same signal. For example, if fan 355 is a fixed speed fan, the control signal may simply be providing (or not providing) the power needed to run the fan.

Figure 5:
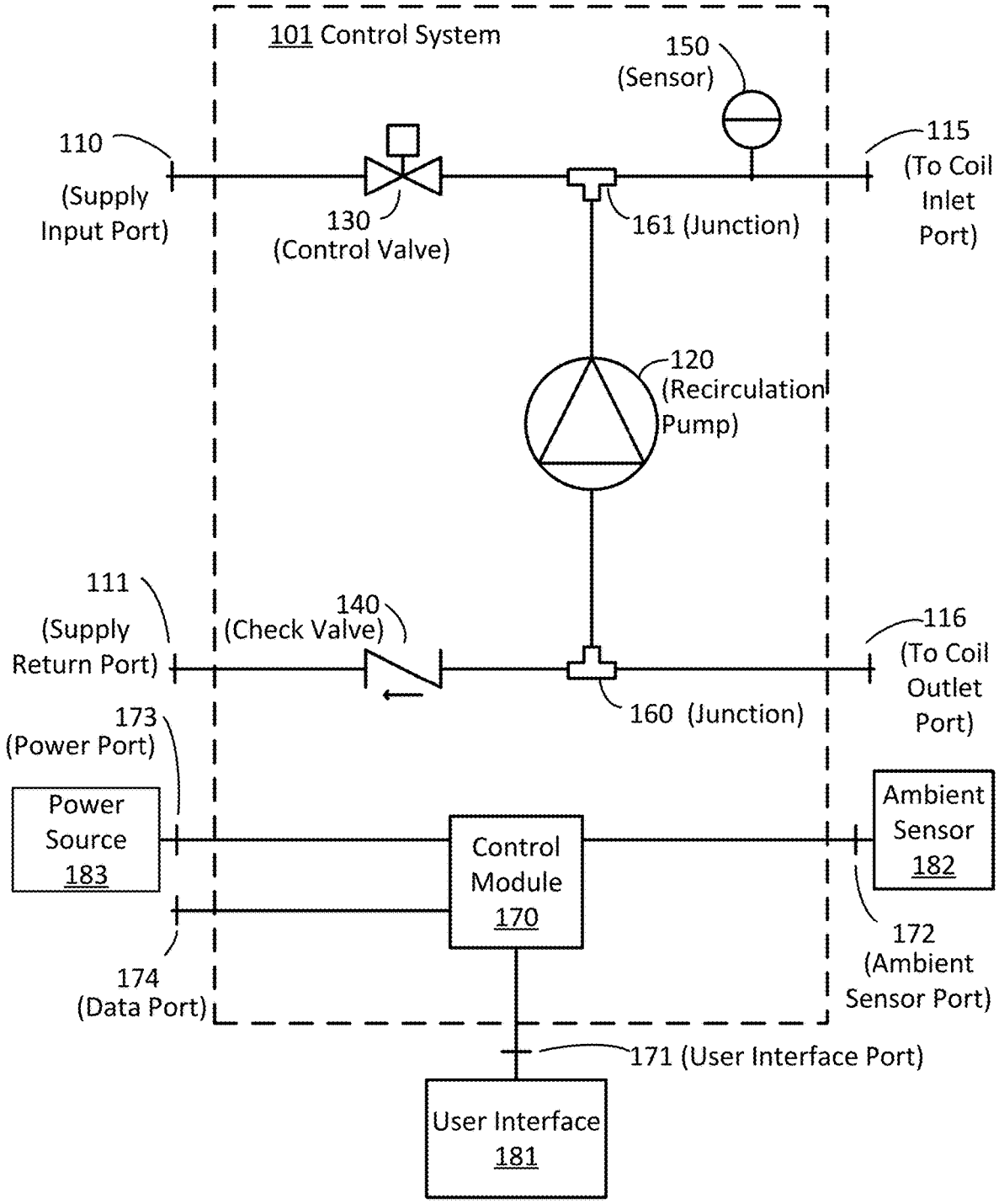
FIG. 5 shows a block diagram of a control system for a terminal unit, according to some embodiments.

FIG. 5 shows an example embodiment of control system 101 used for water-based coolants. In this embodiment, the actuator consists of a control valve 130 and recirculation pump 120. Sensor 150 measures the temperature of the liquid entering the coil through to-coil-inlet port 115. A check valve 140 may be included to prevent back flow. The components are connected together with suitable piping as shown. Notably, cold water entering from supply input port 110 passes through control valve 130. At junction 161 the supply water is mixed with water returned from the coil and pumped by recirculation pump 120. The return water will generally be warmer than the cold supply water, thus by controlling how much control valve 130 is open and/or the speed of pump 120 a desired input temperature can be achieved and verified by measurements from sensor 150. After passing through the coil of the terminal unit, water returns to the control system via to-control-outlet port 116. The returned water is split at junction 160 with some being pumped by pump 120 for mixing with fresh supply water, and some being returned via supply return port 111. Note, the position of control valve 130 and check valve 140 can be switched and the same operation can be achieved.

Further discussion of how the desired temperature of the water is determined from ambient conditions and the set point, and in turn how the control valve 130 and pump 120 are controlled, as well as several related configurations are presented in in U.S. Pat. No. 11,054,167 titled "System and Apparatus for Conditioning of Indoor Air" issued on Jul. 6, 2021, the entirety of which is incorporated by reference (hereinafter the '167 patent).

A conditioning system 100 using the control system 101 shown in FIG. 5 may be operated, according to some embodiments, as follows. The setpoint temperature is specified as well as the mode of operation (e.g., cooling, heating, auto, standby). Assuming the mode requires cooling and the room temperature is above the setpoint temperature, and there is no moisture accumulation on the coil, feedback control is used to determine the target temperature of the water measured by sensor 150 based on the ambient conditions and the setpoint temperature. The target temperature of the coolant water entering the coil is constrained on the low end differently depending on whether additional moisture accumulation is permissible within the terminal unit. If moisture accumulation is currently permissible the low end of the target water temperature may be unconstrained, set to the supply input water temperature which is typically fixed by the chiller system being used to generate cold water (45 degrees Fahrenheit is a typical supply water temperature), or constrained by another value which may be below the dew point of the ambient air (e.g., 2, 3, 5, 8 or more degrees C. or F below the dew point of the room air). If further moisture accumulation in the terminal unit is not currently permitted, the water temperature may be constrained by the dew point temperature of the ambient air. The implemented constraint may be the dew point, slightly above the dew point to provide a safety margin, or even slightly below the dew point to reflect the fact that the exterior surface of the coil over which the air passes may still be above the dewpoint when the water temperature is below the dew point due to the temperature gradients in the cross section of the coil.

Whether moisture accumulation is permitted may be determined by the measure of moisture accumulation in the terminal unit relative to a threshold. If the moisture accumulation is below the threshold, further moisture accumulation (latent cooling) is permitted. If the moisture accumulation is above the threshold, latent cooling is not permitted.

In some embodiments, when the difference between the ambient air temperature and the setpoint temperature is large, the control system will use the coldest target water temperature permissible. Assuming cooling starts without moisture accumulated on the coil, cooling water well below the dew point may initially be provided to the coil to maximize cooling. As the conditioned space cools down, moisture accumulates on the coil in the terminal unit. Ideally the threshold moisture accumulation is sufficiently high that the setpoint temperature can be reached before the moisture accumulation threshold is reached. If that is the case, and the system is reasonably sized and operating with design conditions, the temperature of the water needed to maintain the setpoint temperature will be above the dew point. Thus, because the coil will be above the dew point temperature, the moisture accumulated on the coil will begin to evaporate back into the air even as the temperature setpoint is maintained. Eventually, all the moisture accumulated in the terminal unit will evaporate. The net result will be that by allowing the coil of the terminal unit to perform latent cooling, the overall rate of cooling was increased allowing the system to reach the set point temperature more quickly.

If the moisture accumulation threshold is reached at any time, further cooling by the coil is not prevented, but the rate of cooling simply slowed down by restricting the water temperature that can be used for cooling so as to avoid any further latent cooling on the coil.

Advantageously, because this system allows for latent cooling to be performed at the terminal unit without requiring a drainage system, the cost of a drainage system is avoided and the capacity required of the DOAS can be reduced. As the DOAS is a high-cost component, significant cost savings can be achieved by reducing the DOAS capacity requirements.

It should be appreciated that latent cooling can be used to accelerate cooling under a wide variety of terminal unit configurations. For systems where the temperature of the coolant is measured it is clear that if latent cooling is permitted, the temperature of the coolant may be allowed to go significantly below the dew point, and if latent cooling is not permitted the temperature of the coolant should not be allowed to go significantly below the dew point. "Significant" here means that the temperature on the outside surface of the coil is caused to be below the dew point. In embodiments where the latent cooling rate is measured, a feedback control loop may be used to dynamically determine how cold the coolant may be without resulting in latent cooling. More specifically, assume maximum cooling is called for by the system (e.g., the setpoint is well below the ambient temperature); once the threshold moisture accumulation is reached the minimum water temperature may be reduced to a predetermined value relative to the dew point. If that predetermined value results in further latent cooling it is apparent that the predetermined value is too low in temperature and must be increased. On the other hand, if the rate of latent cooling rate indicates evaporation is occurring, that can be taken as an opportunity to further increase the rate of cooling by decreasing the minimum coolant temperature until the rate of latent cooling is zero. Of course, evaporation may be desired even in maximum cooling to correct any overshoot in moisture accumulation over the threshold. If desired, the control system may be designed to prevent overshoot.

With respect to systems where the actuator 421 is modulated to control a property other than temperature which cannot be directly related to the dew point of the recirculation air, the property must be restricted to a range that does not result in latent cooling. Again, since the latent cooling rate may be monitored, the value of the property of the coolant defining the end of the range can be feedback controlled based on the latent cooling rate measurements.

The goal of some embodiments is to bound the rate of cooling to a maximum rate of latent cooling if latent cooling is permitted, and to bound the rate of cooling to a maximum rate with zero latent cooling once the threshold moisture accumulation has been exceeded. The actual rate of cooling will either be at the applicable maximum rate of cooling or below it since maximum cooling will not be required at all times (e.g., once the set point is reached cooling need only maintain the ambient conditions at the set point requiring a lower rate of cooling). It is noted that air conditioned by a DOAS and provided to the terminal unit via a conditioned air port will likely provide both sensible and latent cooling to the conditioned space. However, the latent cooling provided by the DOAS air should not result in accumulation of moisture within the terminal unit.

In the above discussion it was assumed that the dew point of the air was nominally the temperature at which moisture begins accumulating on the coil. The dynamics of moving air may make the assumption that only a slight temperature gradient exists from the inside of the coil (where the coolant is flowing) to the outside of coil (where air is flowing) inaccurate. If this gradient is large (e.g., because the moving air rapidly transfers heat to the coil) the coolant temperature may need to be several degrees below the dew point before latent cooling begins. How cold the coolant can be before causing latent cooling may depend on the air flow rate pass the coil. In some embodiments the dew point is not used as the reference for zero latent cooling but rather an empirically or theoretically determined value is used that accounts for the air speed through the coil. As discussed, in embodiments where latent cooling is measured in real-time during operation, the maximum rate of cooling can be modulated to achieve zero latent cooling, or any other value of latent cooling (including both positive and negative values, the later representing latent heating) as part of the real-time control algorithm. Thus, it should be appreciated that reference to the dew point as the nominal threshold temperature of the coolant for achieving latent cooling is for convenience, and that in some embodiments the coolant may be required to be substantially below the dew point temperature of the air to achieve zero latent cooling.

Figure 6:
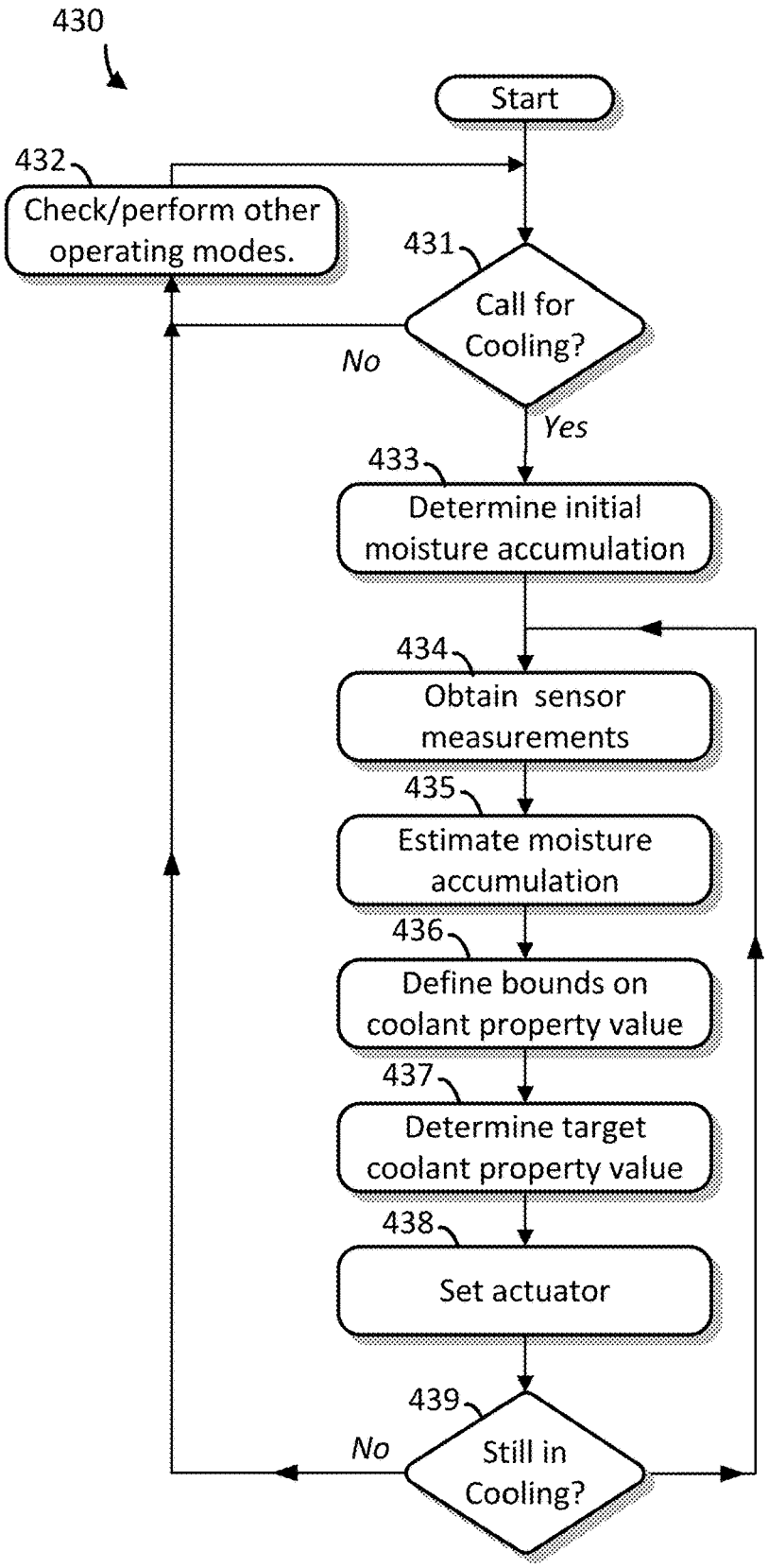
FIG. 6 shows a flow diagram of a method for cooling with a terminal unit, according to some embodiments.

FIG. 6 shows an exemplary method 430 for cooling with a terminal unit according to some embodiments. Method 430 may be implemented in any suitable combination of software and hardware. For example, method 430 may be implemented in control system 101 and terminal unit 300. In some embodiments method 430 is implemented through various algorithm control modules of a control system for a terminal unit.

At step 431, method 430 determines if cooling is required at the terminal unit. If so, the method continues to step 433. If not, the method goes to step 432 where it operates the terminal unit in other modes until another determination is made that cooling is required. It should be appreciated that the check at step 431 may be implemented as an interrupt or in other suitable ways.

If cooling is desired, the method continues to step 433 where it determines the initial moisture accumulation in the terminal unit. The system checks to see if any predetermined conditions (discussed below) which allows the system to assume zero moisture accumulation have been met. If met, the moisture accumulation is reset to zero. If the conditions do not exist, the current estimate of moisture accumulation may be used. On the initial system start up or after a system reboot, since there will not be an estimate of moisture accumulation, the system must wait until a zero-moisture accumulation condition has been met (or assume zero-moisture accumulation at startup); otherwise the system should restrict cooling to prevent latent cooling on the cooling coil.

In some embodiments there are multiple bases for determining there is zero-moisture accumulation in the terminal unit. One condition may be that the moisture accumulation is zero after a "long time" operating in any mode other than cooling since none of the other modes (e.g., heating, standby) provide latent cooling via the coil. What constitutes a long time will depend on the terminal unit, moisture accumulation threshold, the air flow rate through the recirculation-air port and other factors. In some embodiments, a long time may be a few minutes of heating (e.g., coil temperature above the ambient air temperature and well above the dew point). If the coil is not being used (e.g., the terminal unit is in standby) the coil may be dry in minutes to a few hours. (Note, a drip pan could take days to evaporate depending on its capacity, however, some embodiments will have a level sensor to provide observability of this moisture.) Another condition where it may be acceptable to assume the moisture accumulation is zero is if the moisture accumulation on the coil is essentially constant or increasing over a period of time (e.g., 2, 3, 4, 5, 10 minutes or more) in which the coil temperature is above the dew point. Such conditions would result in evaporation (i.e., latent heating) if there was any moisture accumulation. This zero-moisture accumulation condition can be met even during cooling. Note that Eq. 8 is prone to accumulating measurement error due to the nature of integrating imperfect sensor data which may suffer from noise, bias, hysteresis and other shortcoming of practical sensors. Thus, under these conditions any non-zero moisture accumulation and be concluded to be error and zeroed. Another condition for assuming zero-moisture accumulation may be an input provided by a technician provided either through user interface 181 or over data port 174. These are merely exemplary and other suitable conditions for resetting moisture accumulation to zero may be used.

Step 433 may be skipped in embodiments where the terminal unit has a sensor for directly measuring moisture accumulation such as when the terminal unit includes a drip pan and level sensor and such sensor(s) are to be the exclusive measure of moisture accumulation in the terminal unit. More formally, if a non-integral method is being used to determine moisture accumulation, it may be unnecessary to assume an initial state.

Method 430 continues to step 434 where it obtains sensor measurements. Sensor measurements may be obtained from applicable sensors such as all or some of the sensor suite connected to control system 101 such as those discussed in connection with FIGS. 2, 3 and 4.

Method 430 continues to step 435 where it estimates moisture accumulation in the terminal unit. Moisture accumulation may be estimated directly in some embodiments, for example using a level sensor in a drip pan. In some other embodiments moisture accumulation is determined using Eq. 8 with the initial moisture C(0) being the value determined at step 433. In some embodiments Eq. 8 is calculated numerically by calculating a latent cooling rate from the sensor measurements obtained at step 434, possibly in combination with other defined values, multiplying the latent cooling rate by the elapsed time and adding it to the prior moisture accumulation value. Mathematically Eq. 8 may be expressed as a numerical summation as $$C(t) = C(0) + \sum_{j=1}^{n} [Q(t_j)\rho(t_j)(w_r(t_j) - w_i(t_j))](t_j - t_{j-1}) \quad 17$$

The bracketed term is simply the expression for latent cooling rate divided by $h_{we}$ (per Eq. 8). The term $(t_j - t_{j-1})$ time-weights the samples. Measurements are taken at times $t_j$ which in general may not be evenly spaced, though in some embodiments may be evenly spaced in tie. In some embodiments new sensor measurements are obtained at a suitable rate which may be, several times per second to every few seconds or longer. Though any suitable sampling interval may be used. In some embodiments, C(0) is zero for reasons discussed above in connection with step 433. In some embodiments the density of air is assumed to be a known constant and Eq. 17 is simplified to $$C(t) = C(0) + \rho \sum_{j=1}^{n} [Q(t_j)(w_r(t_j) - w_i(t_j))](t_j - t_{j-1}) \quad 18$$

In some embodiments the air flow rate is assumed to be a known constant and Eq. 18 is further simplified to $$C(t) = C(0) + Q_\rho \sum_{j=1}^{n} [(w_r(t_j) - w_i(t_j)](t_j - t_{j-1}) \quad 19$$

In some embodiments only a relative value of the amount of moisture accumulation is desired. In some such embodiments, C(0) may be taken to zero and Eq. 19 may be written $$C(t) \propto \sum_{j=1}^{n} [(w_r(t_j) - w_i(t_j)](t_j - t_{j-1}) \quad 20$$

Note that if an even sampling interval can be assumed the time-weighting term can also be dropped. It should be appreciated that these assumptions and approximations are exemplary and various embodiments may use various combinations of such assumptions and approximations to achieve an acceptable measure of moisture accumulation in the terminal unit.

In some embodiments the latent cooling rate is separately calculated. It should be clear from the discussion above that the latent cooling rate may be calculated using various approximations and assumptions similar to those described in connection with the calculation of moisture accumulation. In some embodiments latent cooling is determined to be occurring if $w_r > w_i$, latent heating is assumed if $w_r < w_i$, and no latent cooling or heating is occurring if $w_r = w_i$.

Next, at step 436, the bounds on the coolant property value are determined based on the amount of moisture accumulation in the terminal unit. Digressing briefly, the control system controls an actuator that affects a property of the coolant flowing into the coil. The control system may control the actuator position with the goal of having the property value measured by a coolant sensor match the target coolant property value. The target coolant property value may be determined by the setpoint temperature from the conditioned space and the actual temperature of the conditioned space (e.g., "room temperature"). (A proportional-integral controller or proportional-integral-differential controller may be used, thus taking into account not only the current values but also historic values.) The range of values the target coolant property value can take is restricted at this step. On one end the target coolant property value is bound by a value that defines the maximum rate of cooling permissible under the present terminal unit conditions. The other bound, defining the minimum rate of cooling permissible under the present terminal unit conditions may be chosen in any suitable way or simply left undefined. In some embodiments, it may be specified such that the minimum rate of cooling is zero (and not negative which would allow heating the conditioned space). Of course, the actuator will have limited capabilities (e.g., a valve can only be fully opened or fully closed, a pump can only achieve a limited range of flow rates) so even if the other bound is not specified the practical limitations of the actuator will effectively establish the second limit.

The bound defining the maximum rate of cooling permissible if the moisture accumulation in the terminal unit is less than the threshold may be chosen, for example, as a value that results in latent cooling but avoids freezing the coil. In embodiments where the coolant property being measured is temperature the maximum rate of cooling bound may be defined by the dew point of the air entering the recirculation-air port less a fixed amount. For example, the dew point minus 1, 2, 4, 5, 8, 10 or 15 degrees Celsius or Fahrenheit. In some embodiments the maximum rate of cooling is chosen to avoid having moisture accumulation on the coil freeze. In some embodiments it may be defined as the temperature of the coolant being provided by the coolant supply system. For example, in water coolant systems, the cold-water supply is often 45° F., so as a practical matter the coolant will not be colder than that temperature regardless of the maximum cooling rate permitted by the control system. In some embodiments no bound is set on the maximum rate of cooling if the moisture accumulation is below threshold and the limitations of the system effectively limit the maximum rate of cooling. Of course, it may be assumed the maximum rate of cooling for the system is sufficient to result in latent cooling and thus moisture accumulation on the coil (otherwise there would be no need to control moisture accumulation on the coil).

The bound defining the maximum rate of cooling permissible if the moisture accumulation in the terminal unit is greater than the threshold may be chosen as a value for which the latent cooling rate is not positive. Assuming a perfect thermal conducting coil, if the temperature is the coolant property being controlled, the bound for maximum cooling under this circumstance should be the dew point temperature or above. Since the coolant pipe is not a perfect thermal conductor the bound may be slightly below the dew point.

Note that the rate of cooling will depend on air flow rate across the coil, which in some embodiments may be measured, assumed, and/or dependent on factors such as fan speed, damper position, and the condition of an air filter. Thus, if the bound is set as a specific coolant property value (e.g., coolant temperature, coolant flow rate), it should be appreciated that the rate of cooling associated with such coolant property value will vary with air flow rate through the coil even if the coolant property value is constant. Thus, for example, if air flow through the coil is reduced (or increased) it may be desired to change the bound on the coolant property in order to meet a desired maximum rate of cooling. If air flow and/or latent cooling rates are not being measured, it should be appreciated that moisture accumulation itself may be a lagging indicator. Accordingly, the threshold moisture accumulation level should be set sufficiently low to allow responsiveness and avoid exceeding the reservoir capacity of the terminal unit.

In some embodiments, the bound is controlled dynamically to avoid a discrete change in the control at the moisture accumulation threshold. That is, as moisture accumulation approaches the threshold the maximum cooling rate is decreased gradually to reflect the fact that the actuator cannot instantaneously meet the new target coolant property value. Further, once the moisture accumulation is above the threshold, the bound may first be set to ensure evaporation occurs at a reasonable rate to bring the moisture accumulation back to the threshold. As a practical matter such dynamic control of the bound that defines the maximum rate of cooling permissible under the present terminal unit conditions avoids control large discrete changes in the bound as the moisture accumulation level oscillates about the threshold value.

In some embodiments the threshold is dynamically changed. For example, in some embodiments, in order to avoid rapid changing of the bound when the moisture accumulation is essentially at threshold (going above and below it frequently—perhaps due to measurement noise), the threshold may be changed between two threshold values to create a dead band. When the moisture accumulation is increasing the change in the bound defining the maximum rate of cooling is made (to decrease the maximum rate of cooling in this case) when the higher of the two threshold is exceeded. As the moisture accumulation comes back down no change in the bound is made until the moisture accumulation drops below the lower threshold (to increase the maximum rate of cooling in this case). Thus, the threshold is dynamically changed with the applicable threshold being determined based on the historical values of the moisture accumulation.

At step 437 the target coolant property value is determined. The target coolant property value is required to be in the range defined at step 436 and determined from the set point property value and the actual property value of the conditioned space (including historic values in some embodiments). In some embodiments the set point property value and actual property values are temperatures. In some other embodiments, they are a measure of humidity. In some embodiments the control system may be configured to determine the target coolant property value based on both temperature and humidity. Such effectiveness of such control may be enhanced by simultaneously controlling one or more fans and/or one or more dampers of the terminal unit so as to change the cooling provided to the conditioned space by the conditioned air provided from the DOAS and the cooling provided by the coil.

At step 438 the actuator position is set. The control of the actuator position may also feedback controlled based on coolant property measurements obtained by the coolant sensor.

It should be appreciated that multiple actuators may be used to control multiple coolant properties. For example, it may be desired to control both the temperature and the flow rate of the coolant to achieve operation efficiency. In designing a system the relationship between the various coolant properties and the rate of latent cooling should be understood so that bounds can be set appropriately at step 436 to prevent or limit latent cooling under different conditions based on the moisture accumulation in the terminal unit relative to the moisture accumulation threshold. Further, some embodiments may also utilize one or more fans (e.g., fan 355, FIG. 2) or dampers (e.g., damper 393, FIG. 2) to affect the rates of latent and sensible cooling as well as the relative amounts of such cooling provided by the DOAS versus coil 370. For example, by turning on or increasing the speed of fan 355 the rate of cooling provided by coil 370 may be increased.

Finally, at step 439 if the system is still in cooling the processes is repeated beginning at step 434 or, if the system is no longer cooling, the method returns to step 432 to operate in other modes.

In subsequent repetitions of steps 434-439 conditions that would have resulted in a determination that the moisture accumulation is zero may exist. This determination may be more reliable than the moisture accumulation estimated at step 435. Accordingly, step 435 may also check to see if any of the zero-moisture accumulation conditions exist and thus set the moisture accumulation to zero at such time.

Having thus described several aspects of at least one embodiment of this invention, it is to be appreciated that various alterations, modifications, and improvements will readily occur to those skilled in the art. Such alterations, modifications, and improvements are intended to be part of this disclosure and are intended to be within the spirit and scope of the invention. Accordingly, the foregoing description and drawings are by way of example only.

It should be appreciated that the connections between the components moving coolant shown in the drawings and described with reference to embodiments of the conditioning system, terminal unit, control system and the like may be achieved by any suitable pipe, hose, tube, conduit, or other mechanism for conveying liquid and/or gas. Where such connections have been described as a specific conveyance it should be appreciated that other embodiments may use hose, tube, conduit, or any other suitable conveyance.

It should be appreciated that all mechanical and end electrical equipment will have functional limitations. Generally, the ideal behavior has been described so as to not unnecessarily distract from the general operation and description of the embodiments. Those of skill in the art will recognize and appreciate the need to consider both ideal and non-ideal behavior in designing specific embodiments just as with any electrical or mechanical device.

It should also be appreciated that in describing the operation of actuators such as control valve 130 variations of "close" and "open" (e.g., closed, closing, opened, opening) generally refer to the change in the actuator's resistance to flow relative to its current position and do not mean "completely closed" (whereby flow is prevent) or "completely open" (allowing maximum flow) unless it is clear from the context that that is the intended meaning.

It should also be appreciated that the descriptions of components having the same name or same reference number appear in multiple drawings so as to avoid having to describe the common aspects of a component multiple times. It should be clear to those of skill in the art whether such descriptions made with reference to one embodiment are applicable to another embodiment.

Various aspects of the present invention may be used alone, in combination, or in a variety of arrangements not specifically discussed in the embodiments described in the foregoing and is therefore not limited in its application to the details and arrangement of components set forth in the foregoing description or illustrated in the drawings. For example, aspects described in one embodiment may be combined in any manner with aspects described in other embodiments. The above-described embodiments of the present invention can be implemented in any of numerous ways. For example, the embodiments may be implemented using hardware, software or a combination thereof. When implemented in software, the software code can be executed on any suitable processor or collection of processors, whether provided in a single computer or distributed among multiple computers.

Further, it should be appreciated that a computer may be embodied in any of a number of forms, such as a rack-mounted computer, a desktop computer, a laptop computer, or a tablet computer. Additionally, a computer may be embedded in a device not generally regarded as a computer but with suitable processing capabilities, including a Personal Digital Assistant (PDA), a smart phone or any other suitable portable or fixed electronic device.

Also, a computer may have one or more input and output devices. These devices can be used, among other things, to present a user interface. Examples of output devices that can be used to provide a user interface include printers or display screens for visual presentation of output and speakers or other sound generating devices for audible presentation of output. Examples of input devices that can be used for a user interface include keyboards, and pointing devices, such as mice, touch pads, and digitizing tablets. As another example, a computer may receive input information through speech recognition or in other audible format.

Such computers may be interconnected by one or more networks in any suitable form, including as a local area network or a wide area network, such as an enterprise network or the Internet. Such networks may be based on any suitable technology and may operate according to any suitable protocol and may include wireless networks, wired networks or fiber optic networks.

Also, the various methods or processes outlined herein may be coded as software that is executable on one or more processors that employ any one of a variety of operating systems or platforms. Additionally, such software may be written using any of a number of suitable programming languages and/or programming or scripting tools, and also may be compiled as executable machine language code or intermediate code that is executed on a framework or virtual machine.

In this respect, the invention may be embodied as a computer readable medium (or multiple computer readable media) (e.g., a computer memory, one or more floppy discs, compact discs, optical discs, magnetic tapes, flash memories, circuit configurations in Field Programmable Gate Arrays or other semiconductor devices, or other tangible computer storage medium) encoded with one or more programs that, when executed on one or more computers or other processors, perform methods that implement the various embodiments of the invention discussed above. The computer readable medium or media can be transportable, such that the program or programs stored thereon can be loaded onto one or more different computers or other processors to implement various aspects of the present invention as discussed above.

In this respect, it should be appreciated that one implementation of the above-described embodiments comprises at least one computer-readable medium encoded with a computer program (e.g., a plurality of instructions), which, when executed on a processor, performs some or all of the above-discussed functions of these embodiments. As used herein, the term "computer-readable medium" encompasses only a computer-readable medium that can be considered to be a machine or a manufacture (i.e., article of manufacture). A computer-readable medium may be, for example, a tangible medium on which computer-readable information may be encoded or stored, a storage medium on which computer-readable information may be encoded or stored, and/or a non-transitory medium on which computer-readable information may be encoded or stored. Other non-exhaustive examples of computer-readable media include a computer memory (e.g., a ROM, a RAM, a flash memory, or other type of computer memory), a magnetic disc or tape, an optical disc, and/or other types of computer-readable media that can be considered to be a machine or a manufacture.

The terms "program" or "software" are used herein in a generic sense to refer to any type of computer code or set of computer-executable instructions that can be employed to program a computer or other processor to implement various aspects of the present invention as discussed above. Additionally, it should be appreciated that according to one aspect of this embodiment, one or more computer programs that when executed perform methods of the present invention need not reside on a single computer or processor, but may be distributed in a modular fashion amongst a number of different computers or processors to implement various aspects of the present invention.

Computer-executable instructions may be in many forms, such as program modules, executed by one or more computers or other devices. Generally, program modules include routines, programs, objects, components, data structures, etc. that perform particular tasks or implement particular abstract data types. Typically, the functionality of the program modules may be combined or distributed as desired in various embodiments.

Also, data structures may be stored in computer-readable media in any suitable form. For simplicity of illustration, data structures may be shown to have fields that are related through location in the data structure. Such relationships may likewise be achieved by assigning storage for the fields with locations in a computer-readable medium that conveys relationship between the fields. However, any suitable mechanism may be used to establish a relationship between information in fields of a data structure, including through the use of pointers, tags or other mechanisms that establish relationship between data elements.

Also, the invention may be embodied as a method, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

For the purposes of describing and defining the present disclosure, it is noted that terms of degree (e.g., "substantially," "slightly," "about," "comparable," etc.) may be utilized herein to represent the inherent degree of uncertainty that may be attributed to any quantitative comparison, value, measurement, or other representation. Such terms of degree may also be utilized herein to represent the degree by which a quantitative representation may vary from a stated reference (e.g., about 10% or less) without resulting in a change in the basic function of the subject matter at issue. Unless otherwise stated herein, any numerical values appearing in this specification may be modified by a term of degree thereby reflecting their intrinsic uncertainty.

Use of ordinal terms such as "first," "second," "third," etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

Also, the phraseology and terminology used herein is for the purpose of description and should not be regarded as limiting. The use of "including," "comprising," or "having," "containing," "involving," and variations thereof herein, is meant to encompass the items listed thereafter and equivalents thereof as well as additional items.

What is claimed is:

1. A system comprising:

a coil;

an actuator operably connected to the coil for regulating a temperature of coolant entering the coil;

a first humidity sensor to measure a humidity of ambient air;

a second humidity sensor to measure a humidity of air that has passed through the coil; and a controller operably connected to the actuator and operably connected to receive measurements from the first and second humidity sensors, and to (i) determine a rate of latent cooling in the system based at least in part on the humidity of air that has passed through the coil and the humidity of ambient air; (ii) determine a target value for the temperature of the coolant entering the coil based at least in part on the humidity of the ambient air, a setpoint value for the humidity of the ambient air, and the rate of latent cooling; and (iii) control the actuator to achieve the target value for the temperature of the coolant entering the coil.

2. The system of claim 1, wherein the actuator comprises at least one pump.

3. The system of claim 1, further comprising:

a first temperature sensor to measure a temperature of ambient air; and a second temperature sensor to measure a temperature of air that has passed through the coil;

wherein the coil is positioned such that the ambient air entering the system passes through the coil from an entry side of the coil to an exit side of the coil, the second humidity sensor and second temperature sensor are located on the exit side of the coil, and the controller determines the rate of latent cooling in the system by (i) determining a first humidity ratio based at least in part on measurements of the ambient air, (ii) determining a second humidity ratio based at least in part from the second humidity sensor and second temperature sensor, and (iii) determining a difference in moisture content between air entering the coil and air exiting the coil based at least in part on the first and second humidity ratios.

4. The system of claim 3, further comprising:

a supply air port; and a third sensor located to measure air exiting the system via the supply air port, wherein the controller further measures a flow rate of air through the coil based at least in part from measurements from the second and third sensors, and the controller in determining the rate of latent cooling utilizes the measured flow rate of air through the coil.

5. The system of claim 4, further comprising:

a conditioned air port; and an air flow rate sensor to measure an air flow rate through the conditioned air port, wherein the controller further estimates the flow rate of air through the coil based at least further in part on the air flow rate through the conditioned air port.

6. The system of claim 1, further comprising a recirculation air port and an air flow rate sensor, wherein, the coil is located such that ambient air entering the recirculation air port passes through the coil, an air flow rate of the ambient air entering the recirculation air port is measured by the air flow rate sensor, and the controller determines the rate of latent cooling in the system based further at least in part on the air flow rate measured by the air flow rate sensor.

7. A method of cooling a conditioned space, the method comprising acts of:

measuring with a first humidity sensor a humidity of ambient air in the conditioned space;

receiving a setpoint value for the humidity of the ambient air in the conditioned space;

measuring with a second humidity sensor a humidity of air that has passed through a coil in a cooling system for the conditioned space;

determining a rate of latent cooling in the cooling system based at least in part on the humidity of air that has passed through the coil and the humidity of the ambient air in the conditioned space;

determining a target value for a temperature of coolant entering the coil based at least in part on the humidity of the ambient air in the conditioned space, a setpoint value for the humidity of the ambient air in the conditioned space, and the rate of latent cooling; and controlling an actuator of the cooling system to achieve the target value for the temperature of the coolant entering the coil.

8. The method of claim 7, wherein the actuator comprises at least one pump.

9. The method of claim 7, further comprising acts of:

measuring with a first temperature sensor a temperature of the ambient air in the conditioned space; and measuring with a second temperature sensor a temperature of air that has passed through the coil;

wherein the coil is positioned in the cooling system such that ambient air from the conditioned space enters the cooling system and passes through the coil from an entry side of the coil to an exit side of the coil, the second humidity sensor and second temperature sensor are located on the exit side of the coil, and determining the rate of latent cooling comprises acts of (i) determining a first humidity ratio based at least in part on measurements of the ambient air in the conditioned space, (ii) determining a second humidity ratio based at least in part from the humidity of air that has passed through the coil and the temperature of air that has passed through the coil, and (iii) determining a difference in moisture content between air entering the coil and air exiting the coil based at least in part on the first and second humidity ratios.

10. The method of claim 9, further comprising acts of:

measuring with a third sensor a property of air exiting the cooling system via the supply air port;

estimating a flow rate of air through the coil based at least in part from measurements from the second and third sensors, wherein the determining the rate of latent cooling utilizes the measured flow rate of air through the coil.

11. The method of claim 10, further comprising an act of:

measuring with an air flow rate sensor an air flow rate through a conditioned air port of the cooling system, wherein estimating the flow rate of air through the coil is based at least further in part on the air flow rate through the conditioned air port.

12. The method of claim 7, further comprising acts of:

measuring with an air flow rate sensor an air flow rate of the ambient air entering a recirculation air port of the cooling system, wherein determining the rate of latent cooling is based further at least in part on the air flow rate measured by the air flow rate sensor.

* * * * *